US012060765B1

(12) United States Patent
Stone et al.

(10) Patent No.: US 12,060,765 B1
(45) Date of Patent: Aug. 13, 2024

(54) FLOAT SHOE FOR A MAGMA WELLBORE

(71) Applicant: EnhancedGEO Holdings, LLC, St. Petersburg, FL (US)

(72) Inventors: Kevin Martin Stone, Houston, TX (US); Benjamin Chris Smith, Humble, TX (US); James Michael Browning, Houston, TX (US); Shamsul Abedin Al-Tomal, Houston, TX (US); Andrew Nguyen, Richmond, TX (US)

(73) Assignee: EnhancedGEO Holdings, LLC, St. Petersburg, FL (US)

( * ) Notice: Subject to any disclaimer, the term of this patent is extended or adjusted under 35 U.S.C. 154(b) by 0 days.

(21) Appl. No.: 18/226,809

(22) Filed: Jul. 27, 2023

(51) Int. Cl.
*E21B 34/06* (2006.01)
*F24T 10/17* (2018.01)
*F24T 10/00* (2018.01)

(52) U.S. Cl.
CPC ..... *E21B 34/06* (2013.01); *F24T 10/17* (2018.05); *F24T 2010/50* (2018.05)

(58) Field of Classification Search
CPC ..... E21B 34/06; F24T 10/17; F24T 2010/50
USPC ..... 166/328
See application file for complete search history.

(56) References Cited

U.S. PATENT DOCUMENTS 1,043,129 A 11/1912 Murphy
3,498,381 A 3/1970 Earlougher, Jr.
3,613,806 A 10/1971 Malott
3,757,516 A 9/1973 McCabe
3,765,477 A 10/1973 Van Huisen
3,864,208 A 2/1975 Van Huisen
3,950,949 A 4/1976 Martin et al.
3,957,108 A 5/1976 Van Huisen
3,967,675 A 7/1976 Georgii
4,043,129 A 8/1977 McCabe et al.
4,047,093 A 9/1977 Levoy
4,054,176 A 10/1977 Huisen
4,057,108 A 11/1977 Broussard
4,116,285 A 9/1978 Guerber
4,140,184 A 2/1979 Bechtold et al.
4,171,019 A * 10/1979 Cole ..... E21B 41/0014 166/341
4,492,083 A 1/1985 McCabe et al.
(Continued)

FOREIGN PATENT DOCUMENTS

AU 2018308861 A1 1/2020
AU 2017268378 B2 9/2021
(Continued)

OTHER PUBLICATIONS

Boehm, R.F. et al., Modelling of a Magma Energy Geothermal Power Plant, presented at ASME Winter Annual Meeting, Boston MA, Dec. 1987, SAND-87-0564C, DE88 003793, 11 pages.
(Continued)

*Primary Examiner* — Matthew R Buck
*Assistant Examiner* — Patrick F Lambe
(74) *Attorney, Agent, or Firm* — Stephen Y. Liu; James H. Ortega; Carstens, Allen & Gourley, LLP

(57) ABSTRACT

A tubing is anchored in a boiler casing positioned in a borehole that extends into a magma reservoir. The tubing may include a notch that is secured to a tubing anchor receptacle of the boiler casing. The boiler casing may include a float shoe that helps to prevent or restrict the flow of magma from the magma reservoir into the boiler casing and tubing.

20 Claims, 15 Drawing Sheets

(56) References Cited

U.S. PATENT DOCUMENTS

| | | | | |
|---|---|---|---|---|
| 4,642,987 | A | 2/1987 | Csorba et al. | |
| 4,665,705 | A | 5/1987 | Bonham, Jr. | |
| 4,776,169 | A | 10/1988 | Coles, Jr. | |
| 4,929,348 | A | 5/1990 | Rice | |
| 5,513,573 | A | 5/1996 | Sutton | |
| 5,860,279 | A | 1/1999 | Bronicki et al. | |
| 5,911,684 | A | 6/1999 | Shnell | |
| 6,708,494 | B1 | 3/2004 | Hamann | |
| 7,124,584 | B1 | 10/2006 | Wetzel et al. | |
| 8,011,450 | B2 | 9/2011 | Krueger et al. | |
| 8,047,285 | B1 | 11/2011 | Smith | |
| 8,201,409 | B1 | 6/2012 | Zakiewicz | |
| 8,524,787 | B2 | 9/2013 | Ermolaev et al. | |
| 9,006,298 | B2 | 4/2015 | Leviness et al. | |
| 9,108,858 | B2 | 8/2015 | McDonald et al. | |
| 9,150,423 | B2 | 10/2015 | Hosono et al. | |
| 9,182,149 | B2 | 11/2015 | Gilaberte et al. | |
| 9,298,756 | B1 | 3/2016 | Johnson | |
| 9,359,271 | B2 | 6/2016 | Leviness et al. | |
| 9,388,797 | B2 | 7/2016 | Bronicki | |
| 9,574,551 | B2 | 2/2017 | Parrella et al. | |
| 9,738,835 | B2 | 8/2017 | Schrauwen | |
| 9,765,605 | B2 | 9/2017 | Williamson et al. | |
| 10,017,395 | B2 | 7/2018 | Kageyama et al. | |
| 10,058,848 | B2 | 8/2018 | Lipiec et al. | |
| 10,131,545 | B2 | 11/2018 | Sekine et al. | |
| 10,173,202 | B2 | 1/2019 | Hosono et al. | |
| 10,203,162 | B2 | 2/2019 | Yokomine et al. | |
| 10,322,940 | B2 | 6/2019 | Hosono et al. | |
| 10,344,233 | B2 | 7/2019 | Lucas et al. | |
| 10,358,604 | B2 | 7/2019 | Harris et al. | |
| 10,710,049 | B2 | 7/2020 | Mikhajlov et al. | |
| 10,745,625 | B2 | 8/2020 | Dogterom et al. | |
| 10,759,668 | B2 | 9/2020 | Hosono et al. | |
| 10,792,645 | B2 | 10/2020 | Hosono et al. | |
| 10,974,969 | B2 | 4/2021 | Hu et al. | |
| 11,131,484 | B2 | 9/2021 | Mcbay | |
| 11,235,310 | B2 | 2/2022 | Hosono et al. | |
| 11,286,169 | B2 | 3/2022 | Beach et al. | |
| 11,325,105 | B2 | 5/2022 | Beach et al. | |
| 2004/0084182 | A1* | 5/2004 | Edgar | E21B 21/10 166/285 |
| 2004/0131488 | A1* | 7/2004 | Locher | F04B 47/02 417/554 |
| 2004/0265158 | A1 | 12/2004 | Boyapati et al. | |
| 2006/0026961 | A1 | 2/2006 | Bronicki | |
| 2006/0180537 | A1 | 8/2006 | Loftis et al. | |
| 2006/0277917 | A1 | 12/2006 | Hsu | |
| 2008/0213157 | A1 | 9/2008 | McGrady et al. | |
| 2009/0226308 | A1 | 9/2009 | Vandor | |
| 2010/0025260 | A1 | 2/2010 | Naterer et al. | |
| 2010/0045042 | A1 | 2/2010 | Hinders et al. | |
| 2012/0144829 | A1 | 6/2012 | Wiggs et al. | |
| 2013/0101492 | A1 | 4/2013 | McAlister | |
| 2013/0232973 | A1 | 9/2013 | McBay | |
| 2013/0234444 | A1 | 9/2013 | Rogers et al. | |
| 2013/0333383 | A1 | 12/2013 | Schwarck | |
| 2014/0262137 | A1 | 9/2014 | McBay | |
| 2015/0128931 | A1 | 5/2015 | Joshi et al. | |
| 2015/0300327 | A1 | 10/2015 | Sweatman et al. | |
| 2015/0368565 | A1 | 12/2015 | Schrauwen | |
| 2015/0377211 | A1 | 12/2015 | Occhiello | |
| 2016/0097376 | A1 | 4/2016 | Wasyluk et al. | |
| 2016/0115945 | A1 | 4/2016 | Barsi et al. | |
| 2016/0123116 | A1* | 5/2016 | Randle | E21B 43/04 166/243 |
| 2016/0363350 | A1 | 12/2016 | Tahara | |
| 2017/0253492 | A1 | 9/2017 | Beach et al. | |
| 2017/0260829 | A1* | 9/2017 | Aadnøy | E21B 34/06 |
| 2018/0016872 | A1* | 1/2018 | Randle | E21B 21/12 |
| 2018/0106138 | A1 | 4/2018 | Randolph | |
| 2018/0224164 | A1 | 8/2018 | Lakic | |
| 2019/0178391 | A1* | 6/2019 | Gottlieb | B23K 26/342 |
| 2020/0040267 | A1 | 2/2020 | Willigenburg et al. | |
| 2020/0072199 | A1 | 3/2020 | Fontana et al. | |
| 2020/0231455 | A1 | 7/2020 | Beach et al. | |
| 2020/0325030 | A1 | 10/2020 | Cussler et al. | |
| 2020/0353518 | A1 | 11/2020 | Chandran et al. | |
| 2021/0114005 | A1 | 4/2021 | Tao et al. | |
| 2021/0122656 | A1 | 4/2021 | Willberg et al. | |
| 2023/0130169 | A1 | 4/2023 | McIntyre | |

FOREIGN PATENT DOCUMENTS

| | | | |
|---|---|---|---|
| AU | 2016398360 | B2 | 1/2022 |
| CN | 105148824 | A | 12/2015 |
| CN | 108952650 | A | 12/2018 |
| CN | 112604697 | A | 4/2021 |
| CN | 113494273 | A | 10/2021 |
| CN | 113562692 | A | 10/2021 |
| EP | 0236640 | A1 | 9/1987 |
| EP | 0326736 | A2 | 8/1989 |
| EP | 2792010 | B1 | 1/2018 |
| EP | 3583321 | A1 | 12/2019 |
| GB | 2592695 | A | 9/2021 |
| GB | 2615913 | A | 8/2023 |
| JP | h07286760 | A | 10/1995 |
| JP | H10510892 | * | 10/1998 |
| JP | 2011052621 | A | 3/2011 |
| JP | 2014202149 | A | 10/2014 |
| JP | 2020067027 | A | 4/2020 |
| WO | 2009116873 | A1 | 9/2009 |
| WO | 2012079078 | A2 | 6/2012 |
| WO | 2012037571 | A3 | 7/2012 |
| WO | 2013025640 | A2 | 2/2013 |
| WO | 2016204287 | A1 | 12/2016 |
| WO | 2020150245 | A1 | 7/2020 |
| WO | 2020160500 | A1 | 8/2020 |
| WO | 2021257944 | A9 | 4/2022 |
| WO | 2022123626 | A1 | 6/2022 |
| WO | 2022211643 | A1 | 10/2022 |

OTHER PUBLICATIONS

Colp, John L., Final Report—Magma Energy Research Project, Sandia Report, Sand82-2377, Unlimited Release, UC-66, prepared by Sandia National Laboratories under contrace DE-AC04-76DP00789, Printed Oct. 1982, 42 pages.

* cited by examiner

FLOAT SHOE FOR A MAGMA WELLBORE

TECHNICAL FIELD

The present disclosure relates generally to drilling processes and more particularly to a tubing anchor for a magma wellbore.

BACKGROUND

Solar power and wind power are commonly available sources of renewable energy, but both can be unreliable and have relatively low power densities. In contrast, geothermal energy can potentially provide a higher power density and can operate in any weather condition or during any time of day. However, there exists a lack of tools for effectively harnessing geothermal energy.

SUMMARY

This disclosure recognizes the previously unidentified and unmet need for processes and systems for preparing wellbores that extend into underground chambers of magma, or magma reservoirs, such as dykes, sills, or other magmatic formations. This disclosure provides a solution to this unmet need in the form of specially structured boiler casing and tubing that can be deployed in magma wellbores. The boiler casing may include a float shoe that helps to position the boiler casing in the wellbore and prevent (or at least limit) backflows of magma into the boiler casing and tubing. The boiler casing may include a tubing anchor receptacle that is adapted to secure the tubing to the bottom of the boiler casing via a tubing anchor. The tubing anchor receptacle, tubing anchor, and float shoe are structured such that they can be prepared from materials that are resistant to the high temperature and corrosivity of the magma environment.

Geothermal systems that can be achieved according to various examples of this disclosure may harness heat from a magma reservoir with a sufficient energy density from magmatic activity, such that the geothermal resource does not degrade significantly over time. As such, this disclosure illustrates processes for achieving improved systems and methods for capturing energy from magma reservoirs, including dykes, sills, and other magmatic formations, that are significantly higher in temperature than heat sources that are accessed using previous geothermal technologies and that can contain an order of magnitude higher energy density than the geothermal fluids that power previous geothermal technologies. In some cases, the present disclosure can significantly decrease costs and improve reliability of processes used to establish a geothermal wellbore that extends into a magma reservoir. In some cases, the present disclosure may facilitate more efficient electricity production and/or other processes in regions where access to reliable power is currently unavailable or transport of non-renewable fuels is challenging.

Certain embodiments may include none, some, or all of the above technical advantages. One or more technical advantages may be readily apparent to one skilled in the art from figures, description, and claims included herein.

BRIEF DESCRIPTION OF THE FIGURES

For a more complete understanding of the present disclosure, reference is now made to the following description, taken in conjunction with the accompanying drawings and detailed description, in which like reference numerals represent like parts.

DETAILED DESCRIPTION

Embodiments of the present disclosure and its advantages will become apparent from the following detailed description when considered in conjunction with the accompanying figures. In the figures, each identical, or substantially similar component that is illustrated in various figures is represented by a single numeral or notation. For purposes of clarity, not every component is labeled in every figure, nor is every component of each embodiment shown where illustration is not necessary to allow those of ordinary skill in the art to understand the disclosure.

The present disclosure includes unexpected observations, which include the following: (1) magma reservoirs can be located at relatively shallow depths of less than 2.5 km; (2) the top layer of a magma reservoir may have relatively few crystals with little or no mush zone; (3) a magma reservoir does not decline in thermal output over at least a two-year period; (4) eruptions at drill sites into magma reservoirs are unlikely and have not been observed (e.g., eruptions have not happened at African and Icelandic drill sites in over 10,000 years and it is believed a Kilauea, Hawaii drill site has never erupted); and (5) drilling into magma reservoirs can be reasonably safe.

As used herein, "magma" refers to extremely hot liquid and semi-liquid rock under the Earth's surface. Magma is formed from molten or semi-molten rock mixture found typically between 1 km to 10 km under the surface of the Earth. As used herein, "borehole" generally refers to a hole that is drilled to aid in the exploration and recovery of natural resources, including oil, gas, water, or heat from below the surface of the Earth. As used herein, a "wellbore" generally refers to a borehole either alone or in combination with one or more other components disposed within or in connection with the borehole in order to perform exploration and/or recovery processes. In some instances, the terms wellbore and borehole are used interchangeably. As used herein, "fluid conduit" refers to any structure, such as a pipe, tube, or the like, used to transport fluids. As used herein, "heat transfer fluid" refers to a fluid, e.g., a gas or liquid, that takes part in heat transfer by serving as an intermediary in cooling on one side of a process, transporting and storing thermal energy, and heating on another side of a process. Heat transfer fluids are used in processes requiring heating or cooling.

Figure 1:
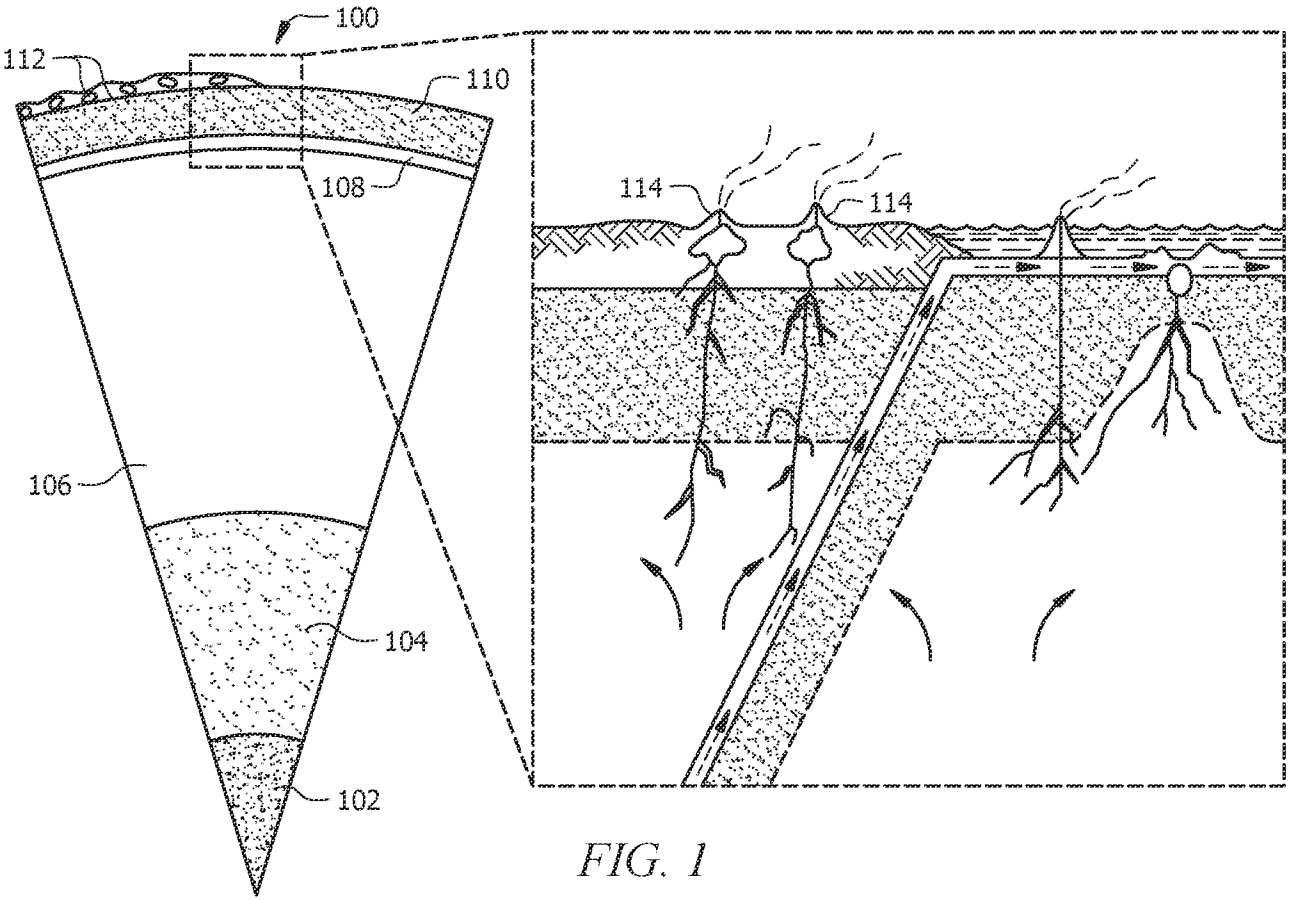
FIG. 1 is a diagram of underground regions near a tectonic plate boundary in the Earth.

FIG. 1 is a partial cross-sectional diagram of the Earth depicting underground formations that can be tapped by geothermal systems of this disclosure (e.g., for generating geothermal power). The Earth is composed of an inner core 102, outer core 104, lower mantle 106, transitional region 108, upper mantle 110, and crust 112. There are places on the Earth where magma reaches the surface of the crust 112 forming volcanoes 114. However, in most cases, magma approaches only within a few miles or less from the surface. This magma can heat ground water to temperatures sufficient for certain geothermal power production. However, for other applications, such as geothermal energy production, more direct heat transfer with magma is desirable.

Figure 2:
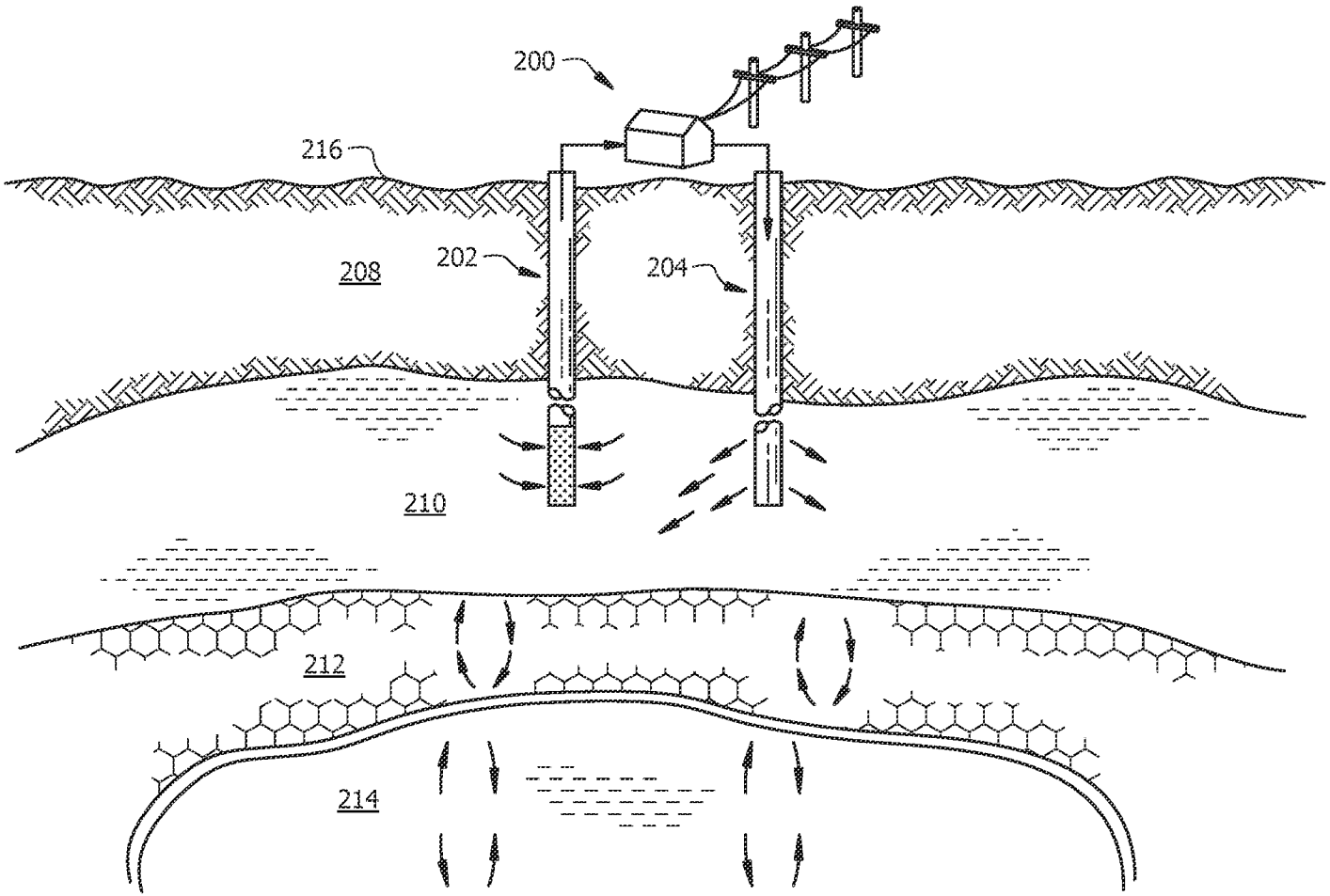
FIG. 2 is a diagram of a previous geothermal system.

FIG. 2 illustrates a conventional geothermal power generation system 200 that harnesses energy from heated ground water. The geothermal system 200 is a "flash-plant" that generates power from high-temperature, high-pressure geothermal water extracted from a production well 202. Production well 202 is drilled through rock layer 208 and into the geothermal fluid layer 210 that serves as the source of geothermal water. The geothermal water is heated indirectly via heat transfer with intermediate layer 212, which is in turn heated by magma reservoir 214. Magma reservoir 214 can be any underground region containing magma such as a dyke, sill, or the like. Convective heat transfer (illustrated by the arrows indicating that hotter fluids rise to the upper portions of their respective layers before cooling and sinking, then rising again) may facilitate heat transfer between these layers. Geothermal water from layer 210 flows to the surface 216 and is used for geothermal power generation. The geothermal water (and possibly additional water or other fluids) is then injected back into layer 210 via injection well 204.

The configuration of conventional geothermal system 200 of FIG. 2 suffers from drawbacks and disadvantages, as recognized by this disclosure. For example, because geothermal water is a multicomponent mixture (i.e., not pure water), the geothermal water flashes at various points along its path up to the surface 216, creating water hammer, which results in a large amount of noise and potential damage to system components. Geothermal water is also prone to causing scaling and corrosion of system components. Chemicals may be added to partially mitigate these issues, but this may result in considerable increases in operational costs and increased environmental impacts, since these chemicals are generally introduced into the environment via injection well 204.

Example Improved Geothermal System

Figure 3:
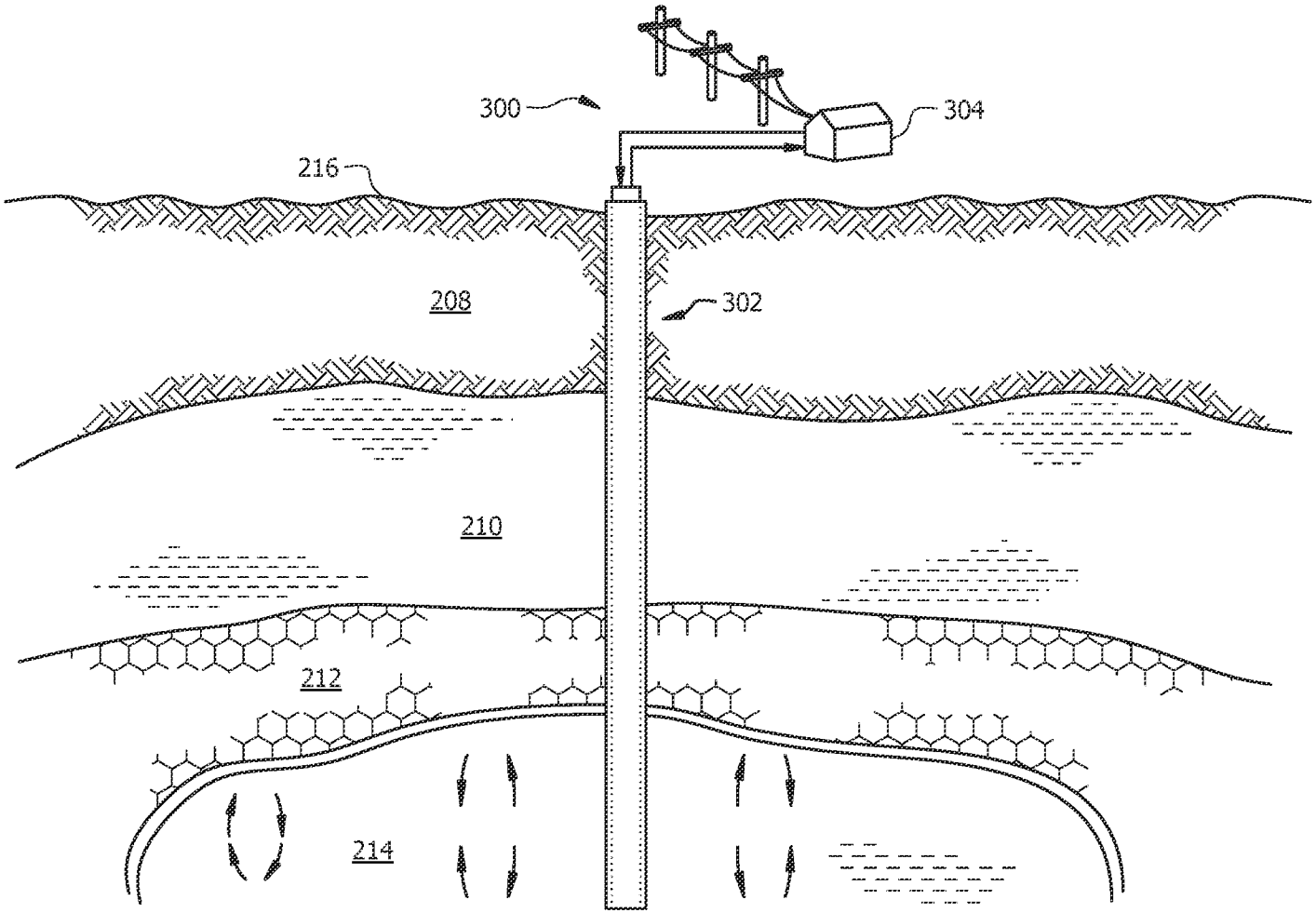
FIG. 3 is a diagram of an example improved geothermal system of this disclosure.

FIG. 3 illustrates an example magma-based geothermal system 300 that can be achieved using the systems and processes of this disclosure. The geothermal system 300 includes a wellbore 302 (referred to also as a "magma wellbore") that extends from the surface 216 at least partially into the magma reservoir 214. The geothermal system 300 is a closed system in which a heat transfer fluid is provided down the magma wellbore 302 to be heated and returned to a thermal or heat-driven process system 304 (e.g., for power generation and/or any other thermal processes of interest). As such, geothermal water is not extracted from the Earth, resulting in significantly reduced risks associated with the conventional geothermal system 200 of FIG. 2, as described further below. Heated heat transfer fluid is provided to the thermal process system 304. The thermal process system 304 is generally any system that uses the heat transfer fluid to drive a process of interest. For example, the thermal process system 304 may include an electricity generation system and/or support thermal processes requiring higher temperatures/pressures than could be reliably or efficiently obtained using previous geothermal technology, such as the system 200 of FIG. 2. Further details of components of an example thermal process system 304 are provided with respect to FIG. 16 below.

The geothermal system 300 provides technical advantages over previous geothermal systems, such as the conventional geothermal system 200 of FIG. 2. The geothermal system 300 can achieve higher temperatures and pressures for increased energy generation (and/or for more effectively driving other thermal processes). For example, because of the high energy density of magma in magma reservoir 214 (e.g., compared to that of geothermal water of layer 210), a single magma wellbore 302 can generally create the power of many wells of the conventional geothermal system 200 of FIG. 2. Furthermore, the geothermal system 300 has little or no risk of thermal shock-induced earthquakes, which might be attributed to the injection of cooler water into a hot geothermal zone, as is performed using the previous geothermal system 200 of FIG. 2.

Furthermore, the heat transfer fluid is generally not substantially released into the geothermal zone by geothermal system 300, resulting in a decreased environmental impact and decreased use of costly materials (e.g., chemical additives that are used and introduced to the environment in great quantities during some conventional geothermal operations). The geothermal system 300 may also have a simplified design and operation compared to those of previous systems. For instance, fewer components and reduced complexity may be needed at the thermal process system 304 because only clean heat transfer fluid (e.g., steam) reaches the surface 216. There may be no need or a reduced need to separate out solids or other impurities that are common to geothermal water.

The example geothermal system 300 may include further components not illustrated in FIG. 3. Further details and examples of different configurations of geothermal systems and methods of their design, preparation, construction, and operation are described in U.S. patent application Ser. No. 18/099,499, filed Jan. 20, 2023, and titled "Geothermal Power from Superhot Geothermal Fluid and Magma Reservoirs"; U.S. patent application Ser. No. 18/099,509, filed Jan. 20, 2023, and titled "Geothermal Power from Superhot Geothermal Fluid and Magma Reservoirs"; U.S. patent application Ser. No. 18/099,514, filed Jan. 20, 2023, and titled "Geothermal Power from Superhot Geothermal Fluid and Magma Reservoirs"; U.S. patent application Ser. No. 18/099,518, filed Jan. 20, 2023, and titled "Geothermal Power from Superhot Geothermal Fluid and Magma Reservoirs"; U.S. patent application Ser. No. 18/105,674, filed Feb. 3, 2023, and titled "Wellbore for Extracting Heat from Magma Chambers"; U.S. patent application Ser. No. 18/116,693, filed Mar. 2, 2023, and titled "Geothermal Systems and Methods with an Underground Magma Chamber"; U.S. patent application Ser. No. 18/116,697, filed Mar. 2, 2023, and titled "Method and System for Preparing a Geothermal System with a Magma Chamber"; and U.S. Provisional Patent Application No. 63/444,703, filed Feb. 10, 2023, and titled "Geothermal Systems and Methods Using Energy from Underground Magma Reservoirs", the entireties of each of which are hereby incorporated by reference.

Example Magma Wellbore

Figure 4:
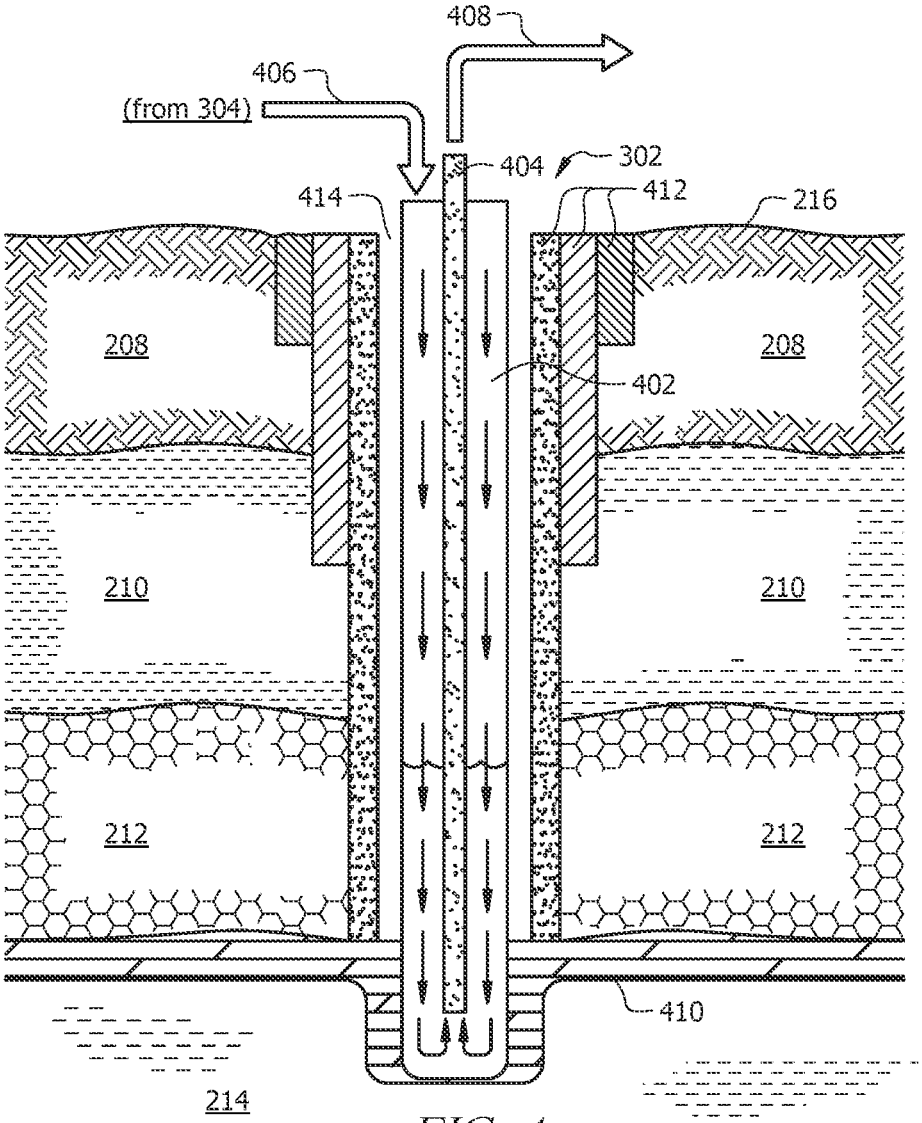
FIG. 4 is an example of the wellbore of the geothermal system of FIG. 3 in greater detail.

FIG. 4 illustrates an example of the magma wellbore 302 of FIG. 3 in greater detail. The example magma wellbore 302 of FIG. 4 includes a boiler casing 402 placed within a borehole 414 extending into the magma reservoir 214. The boiler casing 402 also extends into magma reservoir 214. For example, the boiler casing 402 may extend beyond a ceiling 410 of the magma reservoir 214. The boiler casing 402 may be formed of a thermally resistant cement, an alloy, another thermally resistant material, or combinations of these. The boiler casing 402 may have a specially configured float shoe that aids in placement of the boiler casing 402 in the high temperature environment of the magma reservoir 214 (see FIGS. 6A-6D and 12A-12B and the corresponding descriptions below). The boiler casing 402 may have a specially configured receptacle to receive and hold in place a tubing anchor on tubing 404 (see FIGS. 7A-7D and 14A-14E and the corresponding descriptions below). Further details of an example boiler casing 402 and the placement of a boiler casing 402 within the borehole 414 are described below with respect to FIGS. 5A-12B and 14A-14E.

Tubing 404 is positioned within the boiler casing 402. The tubing 404 may be a fluid conduit with a smaller diameter than that of the boiler casing 402. The tubing 404 may be made of the same material as the boiler casing 402 or a different material. The tubing 404 may have one or more openings at or near its terminal end (see, e.g., openings or orifices 1308 of FIG. 13A) to facilitate the flow of fluid between the boiler casing 402 and the tubing 404. The tubing 404 may be insulated to limit cooling as heated fluid travels toward the surface. The tubing 404 may have a specially configured tubing anchor that couples to the bottom of the boiler casing 402 (see FIGS. 13A-13B and 14A-14E and the corresponding descriptions below). Further details of an example tubing 404 and the anchoring of tubing 404 in the boiler casing 402 are described below with respect to FIGS. 13A-14E.

The magma wellbore 302 may include one or more casings 412 to maintain the structural integrity of the borehole 414 and/or help support the boiler casing 402. The casings 412 may be made of a metal or alloy, such as steel, or another appropriate material. The borehole 414 may be drilled and casings 412 may be established as described, for example, in U.S. patent application Ser. No. 18/099,499, filed Jan. 20, 2023, and titled "Geothermal Power from Superhot Geothermal Fluid and Magma Reservoirs"; U.S. patent application Ser. No. 18/099,509, filed Jan. 20, 2023, and titled "Geothermal Power from Superhot Geothermal Fluid and Magma Reservoirs"; U.S. patent application Ser. No. 18/099,514, filed Jan. 20, 2023, and titled "Geothermal Power from Superhot Geothermal Fluid and Magma Reservoirs"; U.S. patent application Ser. No. 18/099,518, filed Jan. 20, 2023, and titled "Geothermal Power from Superhot Geothermal Fluid and Magma Reservoirs"; U.S. patent application Ser. No. 18/105,674, filed Feb. 3, 2023, and titled "Wellbore for Extracting Heat from Magma Chambers"; U.S. patent application Ser. No. 18/116,693, filed Mar. 2, 2023, and titled "Geothermal Systems and Methods with an Underground Magma Chamber"; U.S. patent application Ser. No. 18/116,697, filed Mar. 2, 2023, and titled "Method and System for Preparing a Geothermal System with a Magma Chamber"; and U.S. Provisional Patent Application No. 63/444,703, filed Feb. 10, 2023, and titled "Geothermal Systems and Methods Using Energy from Underground Magma Reservoirs", each of which is already incorporated herein by reference.

Figure 16:
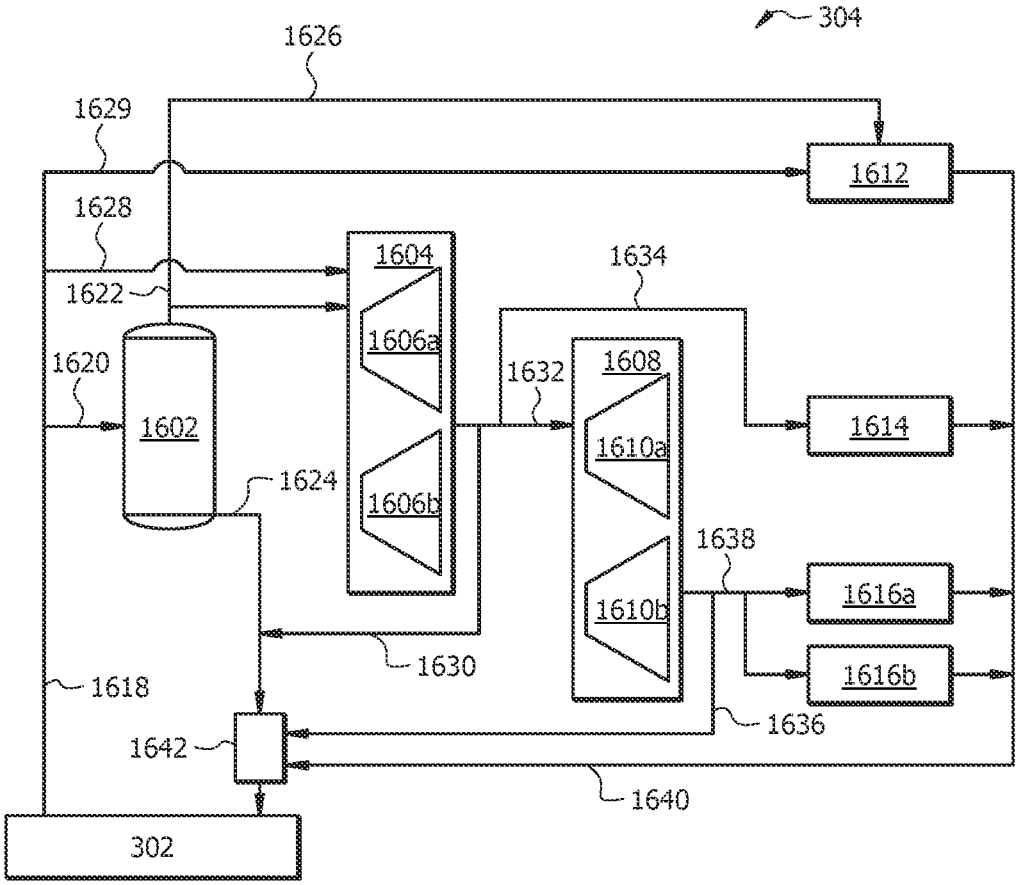
FIG. 16 is a diagram of an example thermal process system of FIG. 3.

During an example operation of the magma wellbore 302, an inlet flow 406 of heat transfer fluid (e.g., relatively cool fluid from thermal process system 304, see FIGS. 3 and 16) is provided into the boiler casing 402. The heat transfer fluid is heated as it travels toward the bottom end of the boiler casing 402 (example flow direction is shown by solid arrows in FIG. 4). The heated heat transfer fluid is then returned to the surface via the tubing 404. An outlet flow 408 of heated heat transfer fluid from the magma wellbore 302 is sent to the thermal process system 304.

The heat transfer fluid may be any appropriate fluid for absorbing heat obtained from the magma reservoir 214 and driving a thermal process as described in this disclosure (see, e.g., FIG. 16). For example, the heat transfer fluid may include water, a brine solution, one or more refrigerants, a thermal oil (e.g., a natural or synthetic oil), a silicon-based fluid, a molten salt, a molten metal, or a nanofluid (e.g., a carrier fluid containing nanoparticles). The heat transfer fluid may be selected at least in part to limit the extent of corrosion of surfaces of various systems described in this disclosure. In some cases, such as to facilitate thermochemical processes requiring higher temperatures than can be achieved using steam or other typical heating fluids, a molten salt heat transfer fluid may be used. A molten salt is a salt that is a liquid at the high operating temperatures required for certain reactors (e.g., at temperatures between 1,600° F. and 2,300° F.). In some cases, an ionic liquid may be used as the heat transfer fluid. An ionic liquid is a salt that remains a liquid at more modest temperatures (e.g., at or near room temperature). In some cases, a nanofluid may be used as the heat transfer fluid. The nanofluid may be a molten salt or ionic liquid with nanoparticles, such as graphene nanoparticles, dispersed in the fluid. Nanoparticles have at least one dimension of 100 nanometers (nm) or less. The nanoparticles increase the thermal conductivity of the molten salt or ionic liquid carrier fluid. This disclosure recognizes that molten salts, ionic liquids, and nanofluids can provide improved performance as heat transfer fluid. For example, molten salts and/or ionic liquids may be stable at the high temperatures that can be reached through heat transfer with magma reservoir 214. The high temperatures that can be achieved by these materials can drive thermochemical processes and/or provide other improvements to performance and/or efficiency that were previously inaccessible using conventional geothermal technology.

Boiler Casing with Tubing Anchor Receptacle

Figure 5A:
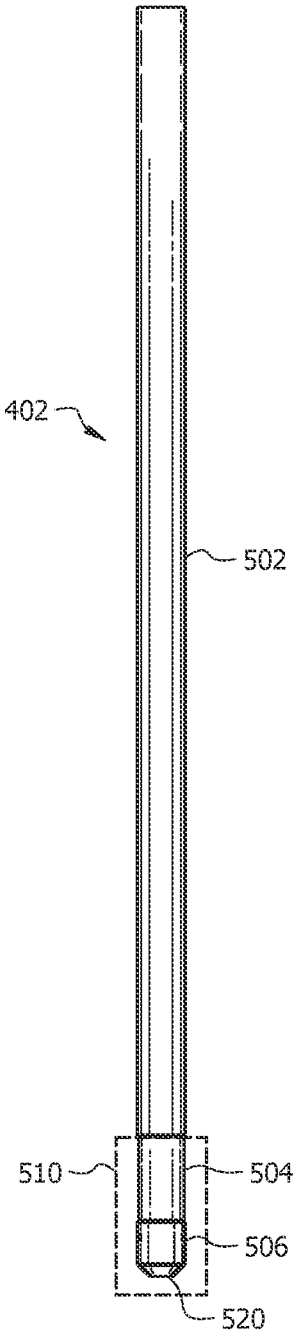
FIGS. 5A and 5B are diagrams illustrating an example boiler casing of the wellbore of FIG. 4.

FIG. 5A shows an example boiler casing 402 of the magma wellbore 302 in greater detail. The example boiler casing 402 includes a casing liner 502, a tubing anchor receptacle 504, and a float shoe 506. The casing liner 502 is generally a cylindrical or approximately cylindrical chamber. The casing liner 502 is coupled to the anchor receptacle 504 at its bottom end which opens into the float shoe 506. The anchor receptacle 504 is configured to receive an anchor of tubing 404 (see tubing anchor 1306 of FIGS. 13A and 13B) and secure the tubing 404 in place within the casing liner 502. The float shoe 506 couples to the anchor receptacle 504 and helps secure the casing liner 502 in position within the borehole 414. The float shoe 506 also includes a valve that controls fluid flow through the end 520 of the boiler casing 402.

Figure 5B:
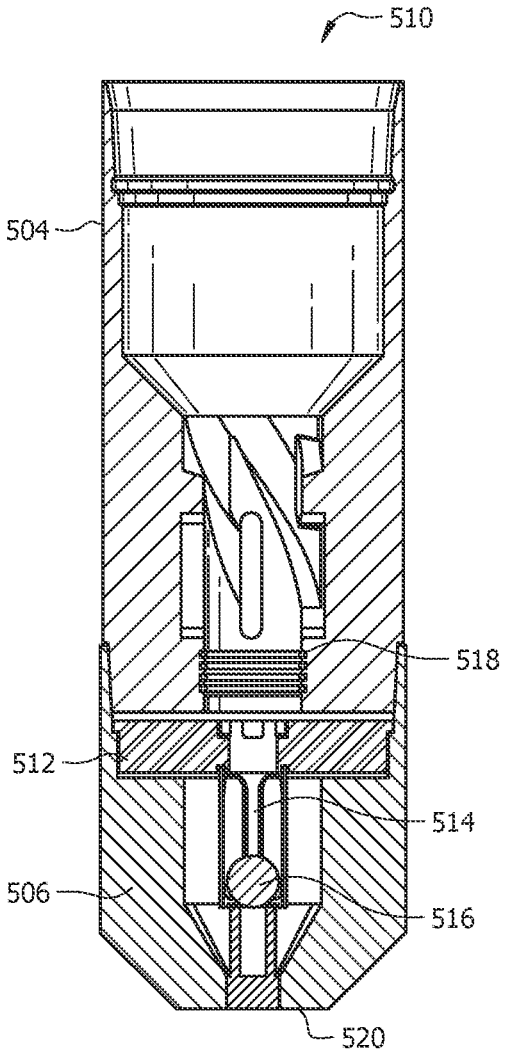

FIG. 5B shows a more detailed view of region 510 of FIG. 5A and a cross section through the tubing anchor receptacle 504 and float shoe 506. Further details of the float shoe 506 and tubing anchor receptacle 504 are provided in the subsections below with respect to FIGS. 6A-6D and 7A-7D, respectively. Briefly, the float shoe 506 is positioned at the terminal or bottom end 520 of the boiler casing liner 502. An opening passes through the float shoe 506, such that, depending on the position of ball 516 in ball cage 514, fluid flow is either allowed or prevented through the float shoe 506. The ball 516 functions as a ball check valve within the ball cage 514. The float shoe 506 is coupled to the tubing anchor receptacle (e.g., via the threads 610 shown in FIG. 6C). Sealing rings 518 are present in the tubing anchor receptacle 504 that help provide a fluid seal between the tubing anchor receptacle 504 and tubing 404 (see tubing anchor 1306 of FIGS. 13A and 13B). The float shoe lock ring 512, ball cage 514, ball 516, and sealing rings 518 are described in greater detail below with respect to FIGS. 8A-11.

Float Shoe

Figure 6A:
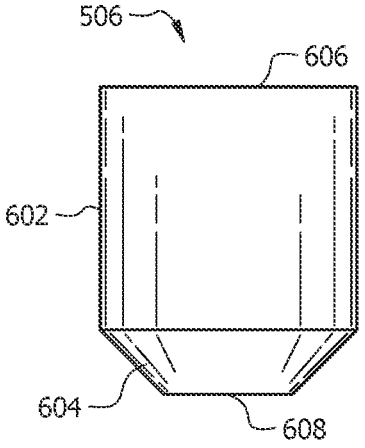
FIGS. 6A, 6B, 6C, and 6D are diagrams illustrating an example float shoe of the boiler casing of FIGS. 5A and 5B.
Figure 6B:
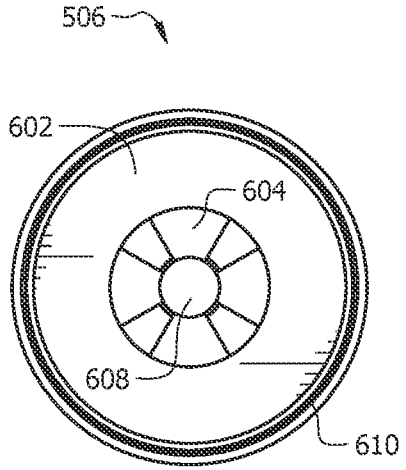
Figure 6C:
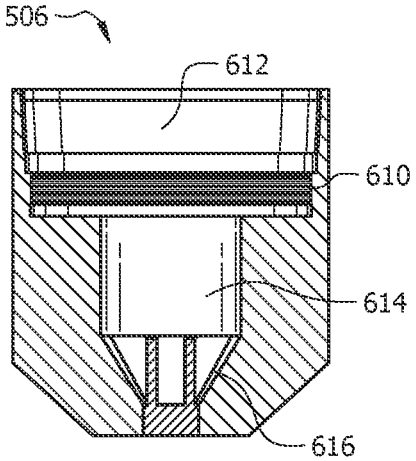
Figure 6D:
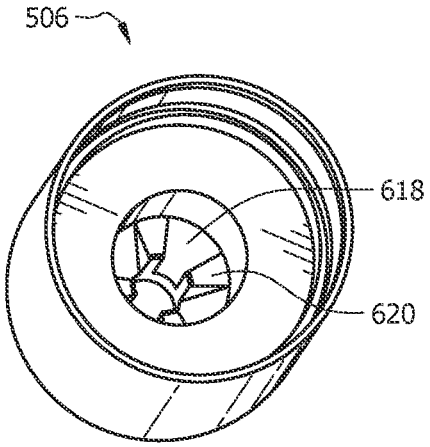

FIGS. 6A-6D show the float shoe 506 from different perspectives. FIG. 6A shows a side view of the float shoe 506. FIG. 6B shows a top-down view of the float shoe 506. FIG. 6C shows a cross-sectional side view of the float shoe 506. FIG. 6D shows a perspective view of the float shoe 506. The float shoe 506 has a body 602 and tapered end 604. An opening though the float shoe 506 extends from top opening 606 through bottom opening 608. A top receptacle 612 is a cylindrical (or approximately cylindrical) region inside body 602 leading from top opening 606 that is sized and shaped to receive the float shoe lock ring 512 (see FIGS. 5B and 8). The top receptacle 612 may be threaded, such that the tubing anchor can be secured within the top receptacle 612. Threads 610 may be used to secure the float shoe lock ring 512 in place within the top receptacle 612.

A lower receptacle 614 is a cylindrical (or approximately cylindrical) opening coupled to the top receptacle 612. The lower receptacle 614 has a smaller diameter than that of the top receptacle 612 and is sized and shaped to secure ball cage 514 in place. The lower receptacle 614 couples the top receptacle 612 to a tapered receptacle 616. The tapered receptacle 616 is coupled to lower receptacle 614 and bottom opening 608. The tapered receptacle 616 has slots 618 formed by notches 620. The slots 618 are configured to receive and secure the ball cage 514 in place. For example, indentations (e.g., indentations 912 of FIG. 9) in the ball cage 514 may align with the notches 620.

Tubing Anchor

Figure 7A:
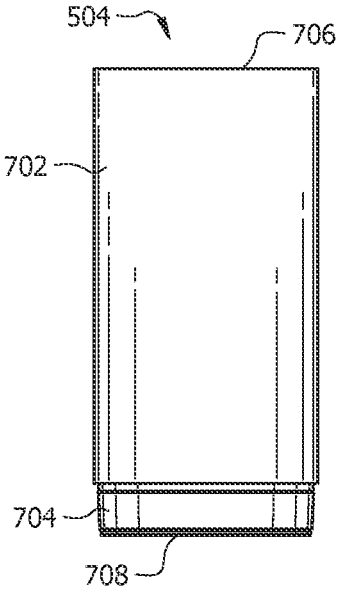
FIGS. 7A, 7B, 7C, and 7D are diagrams illustrating an example tubing anchor receptacle of the boiler casing of FIGS. 5A and 5B.
Figure 7B:
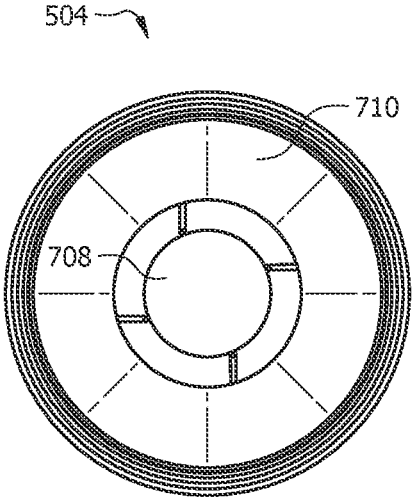
Figure 7C:
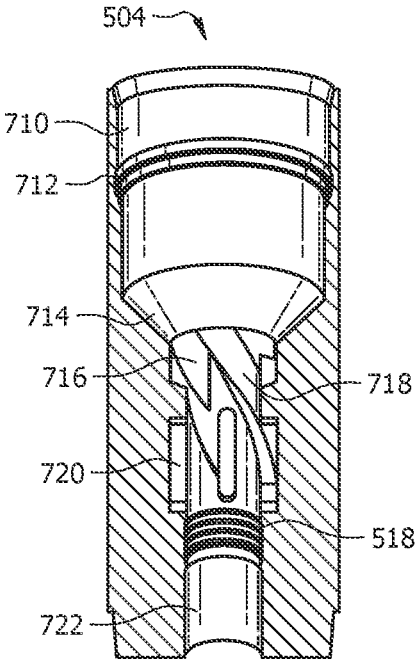
Figure 7D:
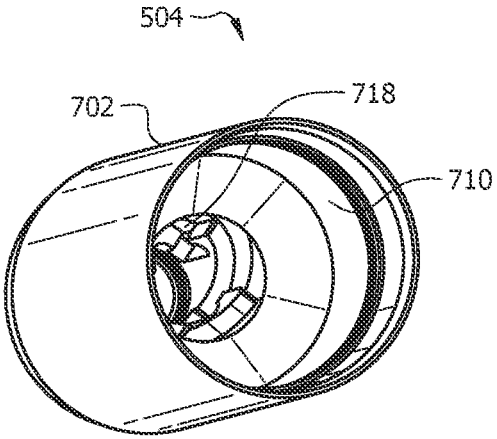

FIGS. 7A-7D show the tubing anchor receptacle 504 from different perspectives. FIG. 7A shows a side view of the tubing anchor receptacle 504. FIG. 7B shows a top-down view of the tubing anchor receptacle 504. FIG. 7C shows a cross-sectional side view of the tubing anchor receptacle 504. FIG. 7D shows a perspective view of the tubing anchor receptacle 504.

The tubing anchor receptacle 504 has an outer body 702 with an end section 704 adapted (e.g., sized and shaped) to fit into the opening 606 of the float shoe 506 (see FIGS. 6A-6D and corresponding description above). The tubing anchor receptacle 504 has a top opening 706 that is coupled to the casing liner 502 and a bottom opening 708 that opens to the float shoe 506. The tubing anchor receptacle 504 has a top receptacle 710, which is the region inside body 702 leading from the top opening 706. Threads 712 may be present to help secure the casing liner 502 to the tubing anchor receptacle 504 (see also FIG. 5A). A tapered region 714 leads from the wider diameter top receptacle 710 into the portions of the tubing anchor receptacle 504 that are adapted to secure to the tubing (e.g., to tubing anchor 1306 of FIGS. 13A and 13B).

A grooved receptacle 716 has helical grooves 718 that lead in a downward spiral direction to vertical grooves 720. Each helical groove 718 leads to and is coupled to a corresponding vertical groove 720. Notches (see, e.g., notches 1312 of FIGS. 13A-13B) on a tubing anchor (see, e.g., example tubing anchor 1306 of FIGS. 13A and 13B) enter the helical grooves 718 when tubing 404 is lowered into the tubing anchor receptacle 504. The notches then move along the helical grooves 718 and enter the vertical grooves 720. Once the notches reach the bottom of the vertical grooves 720, the tubing 404 may be pulled upwards to secure the notches in the top of vertical grooves 720. This process of securing tubing 404 in a boiler casing 402 is illustrated in greater details in FIGS. 14A-14E, described below. The example of FIGS. 7A-7D has four pairs of helical grooves 718 and vertical grooves 720 to receive notches 1312 of the tubing. However, this disclosure contemplates a tubing anchor receptacle 504 having any appropriate number of pairs of helical grooves 718 and vertical grooves 720.

A conduit 722 leads from the grooved receptacle 716 to the bottom opening 708. Sealing rings 518 may be positioned around the conduit 722.

Float Shoe Lock Ring

Figure 8A:
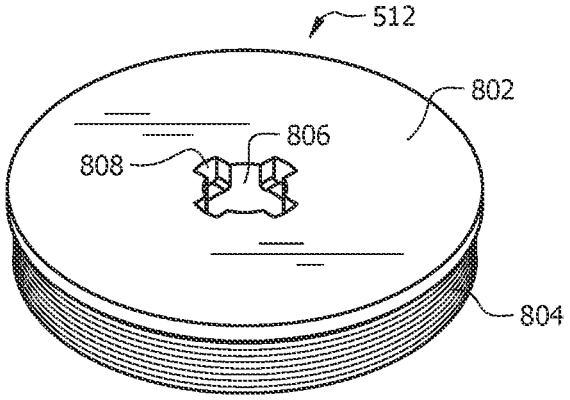
FIGS. 8A and 8B are diagrams illustrating an example float shoe lock ring of the boiler casing of FIGS. 5A and 5B.
Figure 8B:
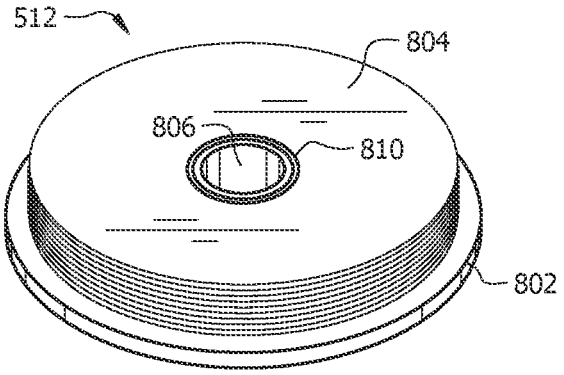

FIGS. 8A and 8B show an example float shoe lock ring 512 in greater detail. FIG. 8A shows a top-down view of the float shoe lock ring 512, and FIG. 8B shows a bottom-up view of the float shoe lock ring 512. The float shoe lock ring 512 fits into the top receptacle 612 of the float shoe 506 (see FIG. 5B). Float shoe lock ring 512 has a top portion 802 and bottom portion 804. Bottom portion 804 may be threaded as shown to be secured into corresponding threads 610 of the top receptacle 612 of the float shoe 506. An opening 806 goes through the float shoe lock ring 512. On the top portion 802 of the float shoe lock ring 512 shown in FIG. 8A, there are indentations 808 around, in, or near the opening 806. A tool may fit into the indentations 808 to rotate the float shoe lock ring to secure the threads of the bottom portion 804 into the corresponding threads 610 of the top receptacle 612 of the float shoe 506. On the surface of the bottom portion 804 of the float shoe lock ring 512 shown in FIG. 8B, an indentation 810 may be present that is sized and shaped to hold the ball cage 514. For example, the top end of the ball cage 514 (e.g., top end 904 of FIG. 9) may fit in the indentation 810.

Temperature Resistant Ball Check Valve

Figure 9:
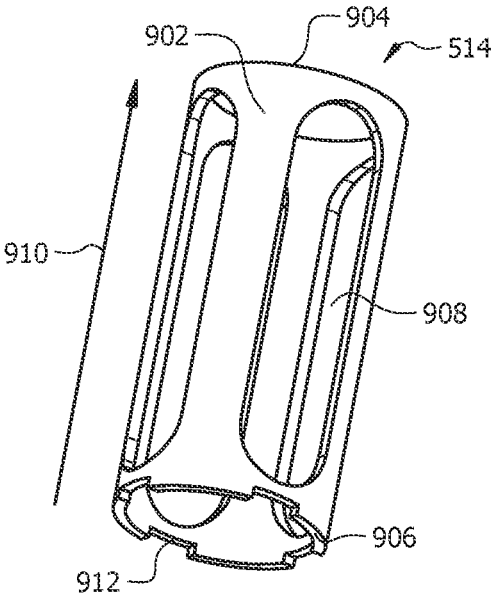
FIG. 9 is a diagram illustrating an example ball cage of the boiler casing of FIGS. 5A and 5B.
Figure 10:
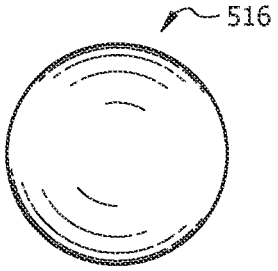
FIG. 10 is a diagram illustrating an example ball of the boiler casing of FIGS. 5A and 5B.

FIGS. 9 and 10 show the ball cage 514 and ball 516, respectively, in greater detail. Together, the ball cage 514 and ball 516 may function as a ball check valve, as described in greater detail below with respect to FIGS. 12A and 12B to allow or restrict the flow of fluid from the opening at the end 520 of the boiler casing 402 into the tubing anchor receptacle 504.

The ball cage 514 is sized and shaped to hold ball 516. Ball cage 514 rests in the slots 618 of the float shoe 506 (see FIG. 6D). The ball 516 is held within and is movable within the ball cage 514 (see FIGS. 5B and 12A-12B). The ball cage 514 may also be secured by the float shoe lock ring 512 (see, e.g., indentation 810 of FIG. 8B).

The ball cage 514 is made up of a hollow cylindrical body 902 extending from a top end 904 to a bottom end 906. The body 902 has openings 908 in the side wall to facilitate movement of the ball 516 along the length 910 of the body 902 (see FIGS. 12A and 12B). The bottom end 906 has indentations 912 that are sized and shaped to align with the notches 620 of the float shoe 506 (see FIG. 6D), such that the ball cage 514 is secured in place.

Figure 12A:
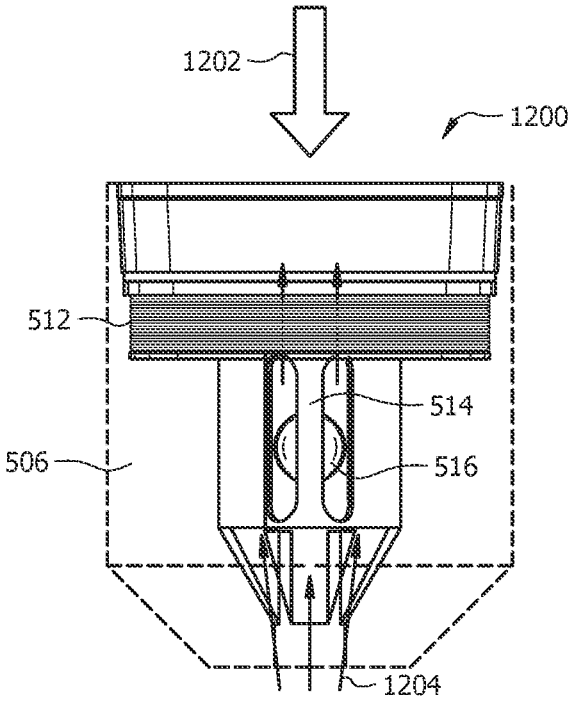
FIGS. 12A and 12B are diagrams illustrating an example operation of the float shoe lock ring of the boiler casing of FIGS. 5A and 5B.
Figure 12B:
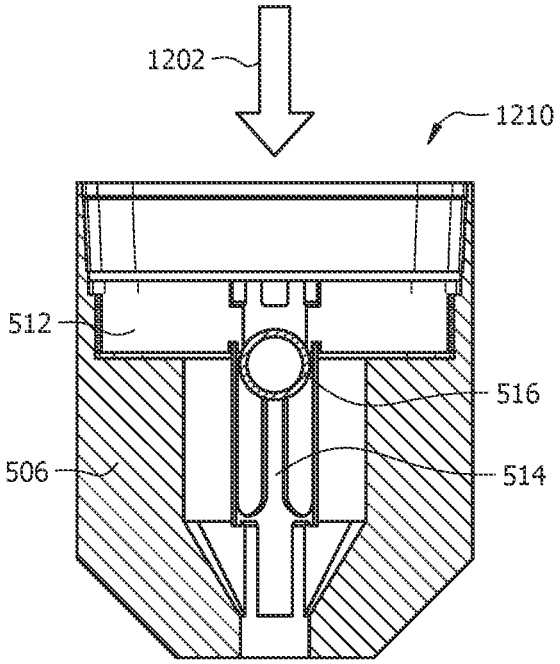

Ball 516 is a spherical or approximately spherical ball with an effective density that is higher than the drilling fluid (e.g., water, a drilling mud, or another appropriate fluid) but slightly lower than that of magma from the magma reservoir 214. This allows the ball to float in magma from the magma reservoir 214 and block flow of magma up the tubing 404 (see FIGS. 12A and 12B). In some cases, the ball 516 may be a hollow ball (e.g., formed of two half spheres welded or otherwise joined together). The ball 516 may be formed of a temperature resistant material, such as a metal, an alloy, a ceramic, or the like. FIGS. 12A and 12B illustrate movement of the ball 516 in the ball cage 514 to control fluid flow.

Sealing Rings

Figure 11:
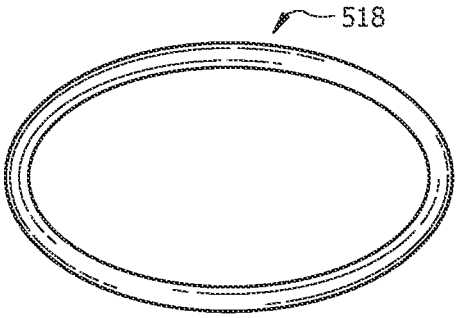
FIG. 11 is a diagram illustrating an example sealing ring of the boiler casing of FIGS. 5A and 5B.

FIG. 11 shows an example sealing ring 518 in greater detail. The sealing ring 518 acts as a gasket to provide a seal between conduit 722 of the tubing anchor receptacle 504 and a tubing anchor secured in the tubing anchor receptacle 504 (see FIGS. 5B and 14A-14E). The sealing ring 518 may be any appropriate size and/or shape to achieve this function. Because of the high temperatures and corrosive environment of the magma reservoir 214, a conventional rubber gasket may fail or be damaged during use. As such, each sealing ring 518 may be a gasket formed of a more thermally stable material, such as a metal or alloy. In use, the sealing rings 518 extend around the conduit 722 of the tubing anchor receptacle 504.

Example Float Shoe Operation

FIGS. 12A and 12B illustrate an example operation of the float shoe 506. FIG. 12A shows a diagram 1200 of the float shoe 506 with the ball 516 in a partially raised position. While the casing 402 is lowered into the borehole 414 (downward motion indicated by arrow 1202), drilling fluid causes the ball 516 to be raised to a partially raised position, allowing the drilling fluid to flow upwards through the ball cage 514 and lock ring 512, as shown by arrows 1204. Thus, the ball 516 can be raised to the partially raised position of FIG. 12A in the presence of the flowing drilling fluid, thereby allowing flow from the opening in the bottom end 520 of the boiler casing 402.

FIG. 12B shows a diagram 1210 of the float shoe 506 with the ball 516 in a fully raised position associated with contacting magma from the magma reservoir 214. As shown in FIG. 12B, when the magma reservoir 214 is encountered, magma may enter the ball cage 514 and cause the ball 516 to float to the fully raised position. With the ball 516 in the fully raised position of FIG. 12B, the flow of magma into the boiler casing 402 is blocked (or at least restricted), thereby helping to protect the boiler casing 402 from intrusions of magma from the magma reservoir 214.

Tubing and Tubing Anchor

Figure 13A:
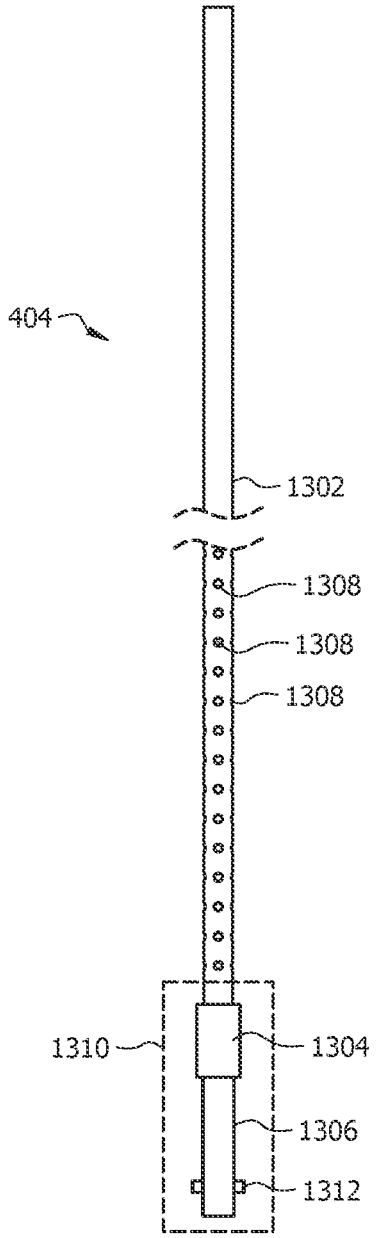
FIGS. 13A, 13B, and 13C are diagrams illustrating example tubing of the wellbore of FIG. 4.
Figure 13B:
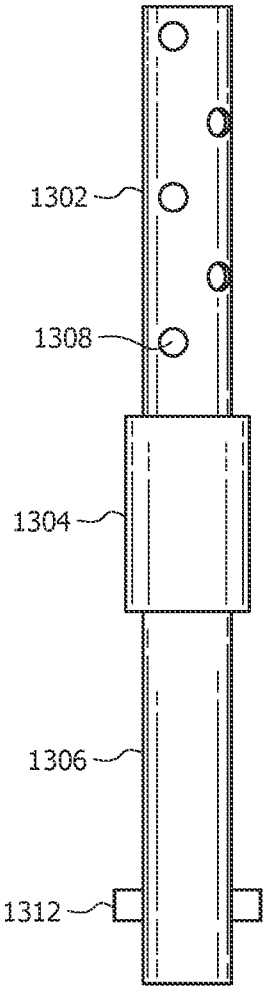
Figure 13C:
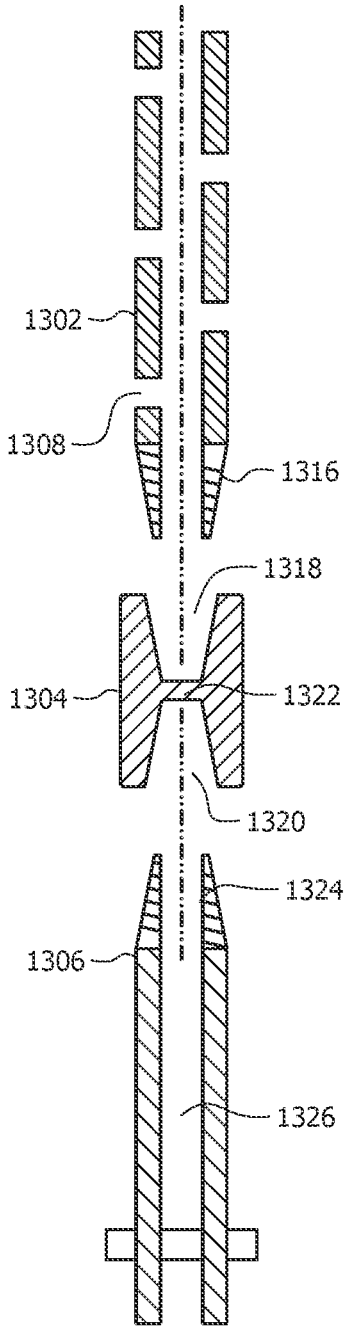

FIG. 13A shows an example of tubing 404 in greater detail. FIG. 13B shows a detailed view of region 1310 of FIG. 13A. FIG. 13C shows a cross-sectional view of the components in region 1310 before they are joined together. The tubing 404 is lowered inside and secured within the boiler casing 402 (see FIG. 4). The example tubing 404 of FIG. 13A includes a main tubing section 1302 attached to a solid cross-over 1304, which is in turn attached to tubing anchor 1306. The main tubing section 1302 is a cylindrical (or approximately cylindrical) conduit (see cross-sectional view of FIG. 13C). The tubing section 1302 may have orifices 1308 that facilitate the flow of fluid between the inside of the boiler casing 402 (e.g., inside casing liner 502) and the inside of the tubing section 1302.

The solid cross-over 1304 is adapted to connect to both the main tubing section 1302 and the tubing anchor 1306. In some cases, an additional adapter/cross-over may be used to join the tubing anchor 1306 to different sizes of the main tubing section 1302. The solid cross-over 1304 may include ends 1318 and 1320 that are adapted to be joined the main tubing section 1302 and the tubing anchor 1306, respectively. For example, a threaded end 1316 of the main tubing section 1302 may be secured within corresponding threads in end 1318 of the solid cross-over 1304. Similarly, a threaded end 1324 of the tubing anchor 1306 may be secured within corresponding threads in the other end 1320 of the solid cross-over 1304. Between the ends 1318 and 1320 there is a solid section 1322 that prevents flow of fluid through the solid cross-over 1304 (i.e., that does not allow the flow of fluid from the tubing anchor 1306 into the main tubing section 1302).

The tubing anchor 1306 includes anchoring notches 1312 that are sized and shaped to fit into the helical grooves 718 of the tubing anchor receptacle 504 (see FIGS. 7A-7D and 14A-14E) and move through the helical grooves 718 to be secured in the vertical grooves 720, as described in greater detail below. The anchoring notches 1312 may be made of a metal, alloy, or other thermally stable and/or corrosion resistant material. The tubing anchor 1306 may have an open bottom end 1314 (see FIG. 14E), which may allow fluid to enter the tubing anchor 1306, which may be at least partially hollow with an open region 1326. Open region 1326 may allow the tubing anchor 1306 to also act as a reservoir for debris, magma, or other material that may inadvertently reach the tubing anchor 1306 from the magma-adjacent environment in the borehole 414 (see, e.g., volume of region 1410 of FIG. 14E, described below). The tubing anchor 1306 may also be simpler and more efficient to manufacture with the open region 1326.

Example Operation of Tubing Anchor and Anchor Receptacle

Figure 14A:
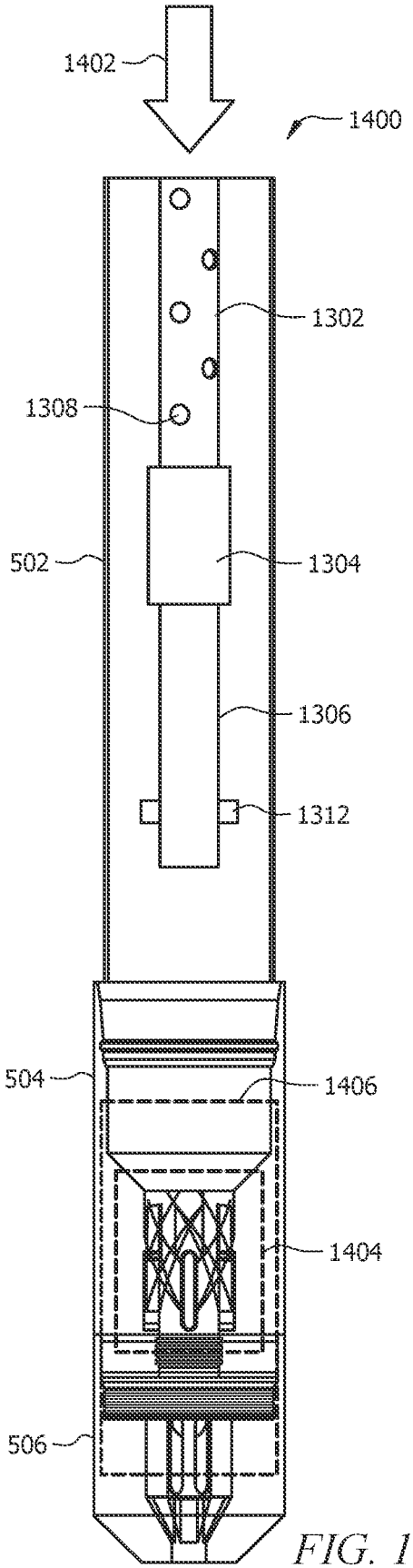
FIGS. 14A, 14B, 14C, 14D, and 14E are diagrams illustrating an example operation of the tubing anchor of FIGS. 13A-13B and the tubing anchor receptacle of FIGS. 7A-7D.

FIGS. 14A-14E illustrate the coupling of a tubing anchor 1306 to a tubing anchor receptacle 504. FIG. 14A shows a diagram 1400 in which the tubing anchor 1306 attached to main tubing section 1302 is lowered toward the tubing anchor receptacle 504. Directional arrow 1402 illustrates this downward movement.

Figure 14D:
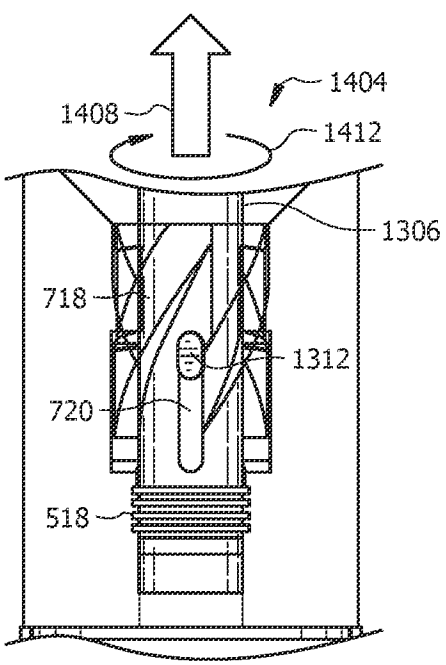
Figure 14C:
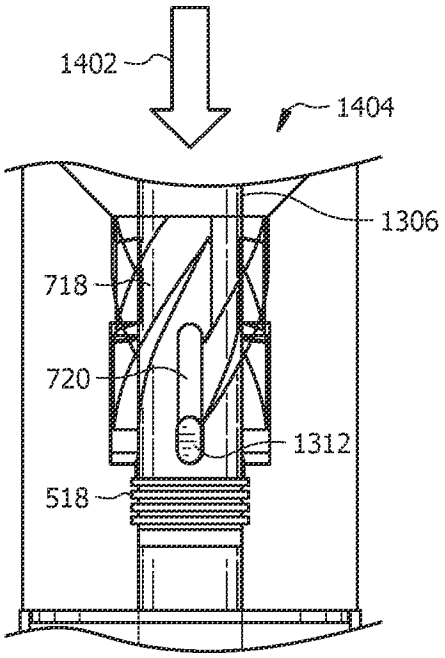
Figure 14B:
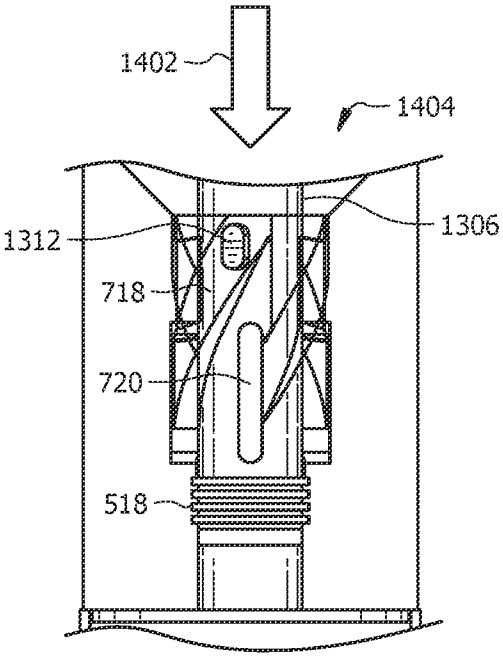

FIG. 14B shows an expanded view of region 1404 of FIG. 14A when the anchoring notches 1312 of the tubing anchor 1306 initially engage with the helical grooves 718 of the tubing anchor receptacle 504. After the anchoring notches 1312 engage with (e.g., enter) the helical grooves 718, the anchoring notches 1312 slide along the helical grooves 718 in a downward direction. The tubing 404 rotates during this downward movement (see arrow 1402). This rotation of the tubing 404 can be observed at the surface to confirm that the tubing anchor 1306 has successfully engaged with the tubing anchor receptacle 504.

FIG. 14C shows an expanded view of region 1404 of FIG. 14A after the anchoring notches 1312 have traversed the helical grooves 718 and entered the bottom end of the vertical grooves 720. The anchoring notches 1312 rest at the bottom of vertical grooves 720, causing the weight of tubing 404 to be at least partially transferred to the casing liner 502, such that an observed weight of tubing 404 decreases. This decrease in weight can be observed at the surface and used to detect when the configuration of FIG. 14C is achieved.

FIG. 14D shows an expanded view of region 1404 of FIG. 14A after the tubing 404 is raised upwards in the direction indicated by arrow 1408. The tubing 404 is raised upwards to secure the tubing 404 in place by placing the anchoring notches 1312 in the top of the vertical grooves 720. This helps hold the tubing 404 in position within the boiler casing 402. The tubing 404 may also be rotated in a rightward direction (i.e., in the direction of arrow 1412) to prevent the anchoring notches 1312 from moving back up the helical grooves 718, such that the tubing 404 disengages from the tubing anchor 1306. If there is a need to remove the tubing 404 from the tubing anchor 1306, the tubing 404 may be lifted and rotated in a leftward direction (i.e., the opposite of direction indicated by arrow 1412), such that the anchoring notches 1312 move upwards along the helical grooves 718 and the tubing 404 is released from the tubing anchor 1306.

Figure 14E:
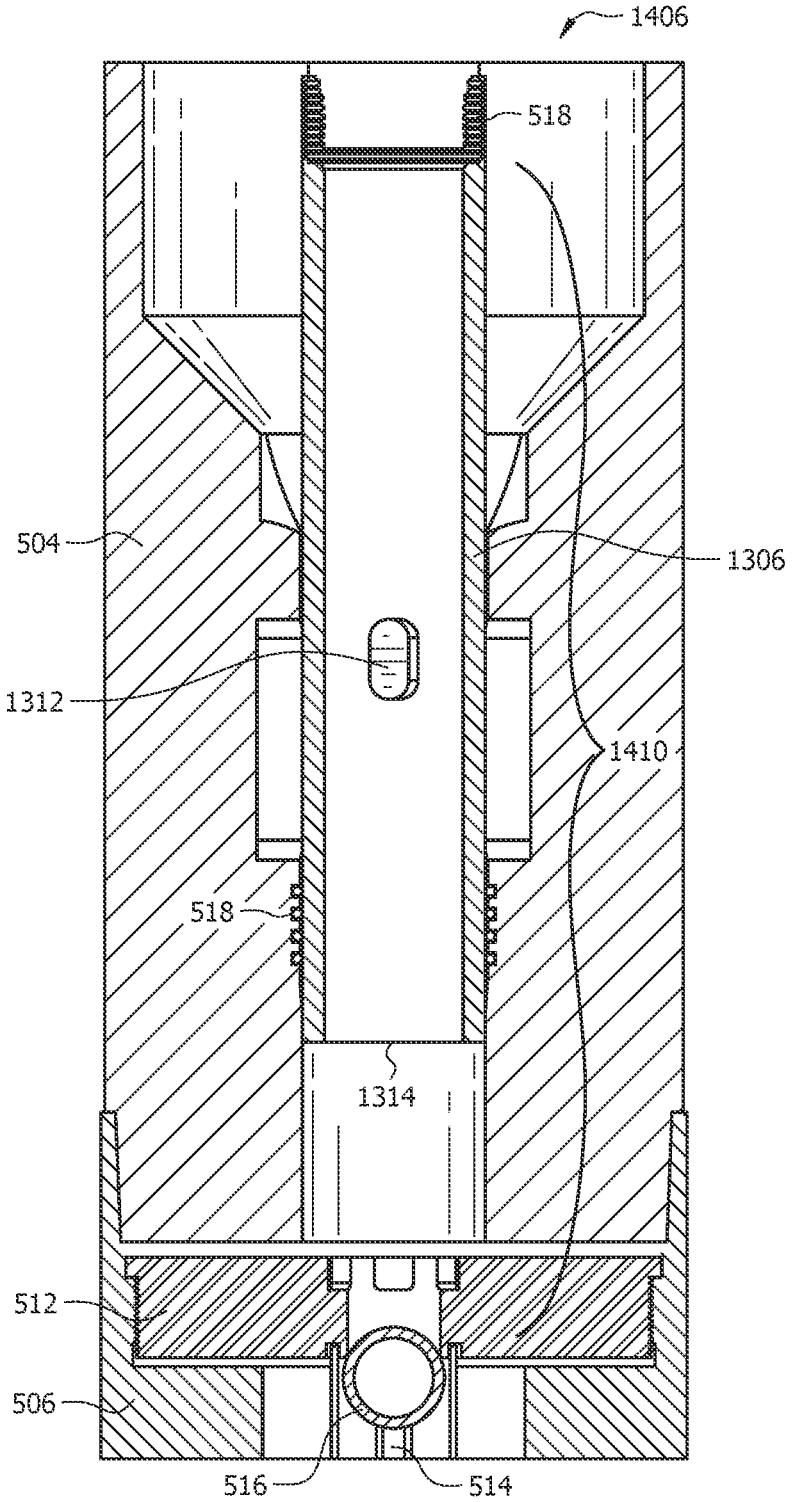

FIG. 14E shows an expanded cross-sectional view of region 1406 of FIG. 14A after the tubing anchor 1306 is secured in place within the tubing anchor receptacle 504. FIG. 14E illustrates how a region 1410 between the floating ball 516 and the top of tubing anchor 1306 provides an initially empty volume that can hold fluid and/or debris that might inadvertently pass the ball 516. In this way, any magma, drilling debris, or other material can be contained with a decreased chance of damaging the boiler casing 402 and/or tubing 404.

Example Method of Preparing a Magma Wellbore

Figure 15:
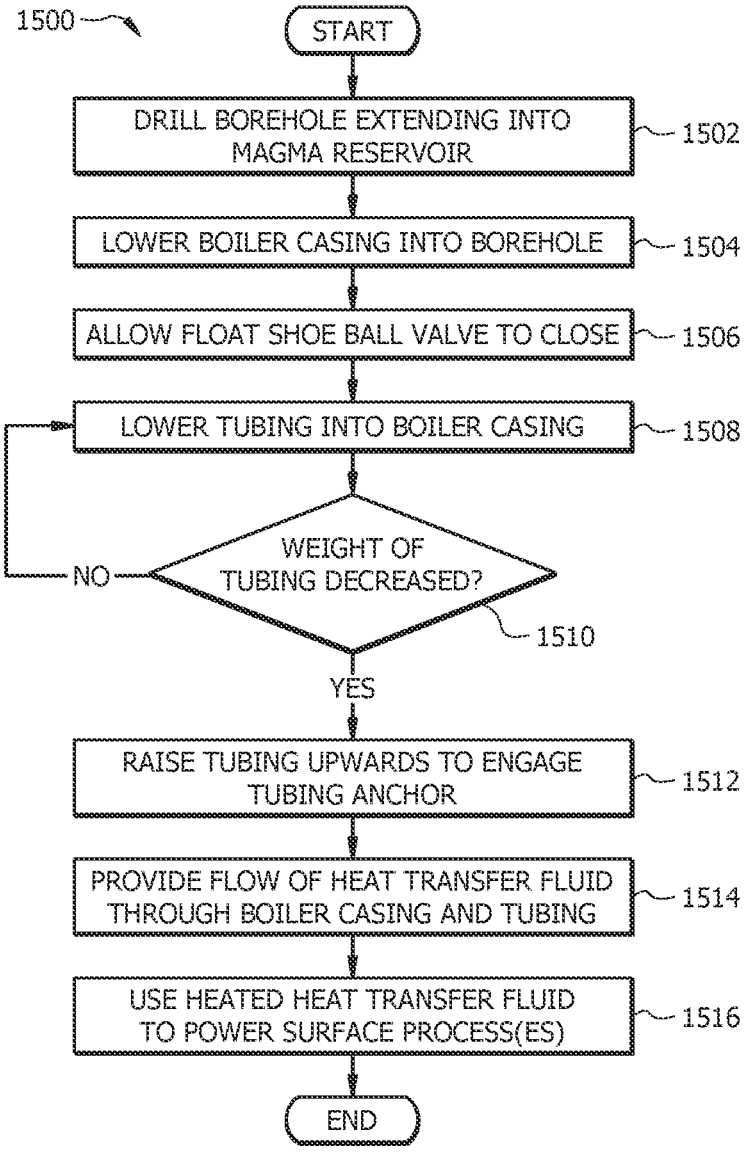
FIG. 15 is a flowchart of an example method for preparing the wellbore of FIG. 4.

FIG. 15 illustrates an example method 1500 of preparing a magma wellbore 302 with tubing 404 secured to a boiler casing 402 (see FIG. 4). The method 1500 may begin at step 1502 where the borehole 414 is drilled that extends into a magma reservoir 214. As an example, the borehole 414 may be drilled until magma is reached in the magma reservoir 214. Once the magma reservoir 214 is reached (or nearly reached) cooling/drilling fluid may be provided down the borehole 414. The cooling/drilling fluid quenches and hardens magma in the magma reservoir 214, thereby allowing this hardened material to be drilled into to form the borehole 414 illustrated, for example, in FIG. 4. For example, the quenched magma may harden to form a rock plug that can be drilled into using an appropriate drill bit. In some cases, cooling/drilling fluid may also be provided down the borehole 414 during previous phases of the drilling process (e.g., before the magma reservoir 214 is reached). The cooling/drilling fluid may be water, a drilling mud, or any other suitable fluid, such as any of the heat transfer fluids described above with respect to FIG. 4.

At step 1504, the boiler casing 402 is lowered into and positioned within the borehole 414. The boiler casing 402 extends into the magma reservoir 214. At step 1506, the ball check valve formed of ball cage 514 and ball 516 is allowed to close to prevent or limit flow of magma into the boiler casing 402, as described above with respect to FIGS. 12A and 12B. For example, as the tubing 404 is lowered into the boiler casing 402, a flow of drilling fluid may be provided through the boiler casing 402 (e.g., to maintain the boiler casing 402 at a manageable temperature). During this time, the drilling fluid may cause the ball 516 to be at a partially raised position (see FIG. 12A) in which fluid flow is allowed through the float shoe 506. Once the float shoe 506 reaches the bottom of the borehole 414 (or near the bottom), magma may enter the float shoe 506 and cause the ball 516 to float to the fully raised position to prevent or limit flow of magma through the float shoe 506 and into the tubing anchor receptacle 504 (see FIG. 12B).

At step 1508, the tubing 404 is lowered into the boiler casing 402. At step 1510, a decrease in weight of the tubing 404 is detected. The decrease in weight corresponds to the anchoring notches 1312 reaching the bottom of the vertical grooves 720 (see FIG. 14C and corresponding description). Under this condition, weight of the tubing 404 is transferred to the boiler casing 402. During or prior to step 1510, a rotation of the tubing 404 may be detected associated with the anchoring notches 1312 engaging with and moving within the helical grooves 718 (see FIG. 14B and the corresponding description above). If the decrease in weight is detected, the method 1500 proceeds to step 1512. Otherwise, the method 1500 returns to step 1508, and the tubing 404 continues to be lowered.

At step 1512, the tubing 404 is raised. Raising the tubing 404 causes the anchoring notches 1312 to move to a secured position in the top of the vertical grooves 720 (see FIG. 14D). In some cases, the tubing 404 is rotated (e.g., in the rightward direction illustrated by arrow 1412 of FIG. 14D) to prevent the anchoring notches 1312 from entering the helical grooves 718 and causing the tubing 404 to disengage from the tubing anchor 1306. In the secured position, the tubing 404 cannot be lifted out of the boiler casing 402 (e.g., without damaging the tubing anchor receptacle 504, the tubing anchor 1306 or another component of the wellbore 302).

At steps 1514 and 1516, operations may be performed to operate the wellbore 302 as part of the overall geothermal system 300. For example, at step 1514, a heat transfer fluid may be provided down the boiler casing 402 and sent back to the surface via the anchored tubing 404 (or vice versa). At step 1516, the heated heat transfer fluid received at the surface 216 may be used to power a thermal process (e.g., for electricity generation, thermochemical reactions, and/or the like). For example, the heated heat transfer fluid may be provided to the thermal process system 304 of FIGS. 3 and 16.

Modifications, omissions, or additions may be made to method 1500 depicted in FIG. 15. Method 1500 may include more, fewer, or other steps. For example, at least certain steps may be performed in parallel or in any suitable order. Any suitable drilling equipment or associated component(s) may perform or may be used to perform one or more steps of the method 1500.

Example Thermal Processing Systems

FIG. 16 shows a schematic diagram of an example thermal process system 304 of FIG. 3. The thermal process system 304 includes a steam separator 1602, a first turbine set 1604, a second turbine set 1608, a high-temperature/pressure thermochemical process 1612, a medium-temperature/pressure thermochemical process 1614, one or more lower temperature/pressure processes 1616*a,b*, and a condenser 1642. The thermal process system 304 may include more or fewer components than are shown in the example of FIG. 16. For example, a thermal process system 304 used for power generation alone may omit the high-temperature/ pressure thermochemical process 1612, medium-temperature/pressure thermochemical process 1614, and lower temperature/pressure processes 1616*a,b*. Similarly, a thermal process system 304 that is not used for power generation may omit the turbine sets 1604, 1608. As a further example, if heat transfer fluid is known to be received only in the gas phase, the steam separator 1602 may be omitted in some cases. The ability to tune the properties of the heat transfer fluid received from the unique wellbore 302 of FIG. 3 facilitates improved and more flexible operation of the thermal process system 304. For example, the depth of the wellbore 302, the residence time of heat transfer fluid in the wellbore 302, the pressure achieved in the wellbore 302, and the like can be selected or adjusted to provide desired heat transfer fluid properties at the thermal process system 304.

In the example of FIG. 16, the thermal process system 304 receives a stream 1618 from the wellbore 302. One or more valves (not shown for conciseness) may be used to control the allocation of stream 1618 within the thermal process system 304, e.g., to a steam separator 1602 via stream 1620, and/or to the first turbine set 1604 via stream 1628, and/or to the thermal process 1612 via stream 1629. Thus, the entirety of stream 1618 can be provided to any one of streams 1620, 1628, or 1629, or distributed equally or unequally among streams 1620, 1628, and 1629.

The steam separator 1602 is connected to the wellbore 302 that extends between a surface and the underground magma reservoir. The steam separator 1602 separates a gas-phase heat transfer fluid (e.g., steam) from liquid-phase heat transfer fluid (e.g., condensate formed from the gas-phase heat transfer fluid). A stream 1620 received from the wellbore 302 may be provided to the steam separator 1602. A gas-phase stream 1622 of heat transfer fluid from the steam separator 1602 may be sent to the first turbine set 1604 and/or the thermal process 1612 via stream 1626. The thermal process 1612 may be a thermochemical reaction requiring high temperatures and/or pressures (e.g., temperatures of between 500° F. and 2,000° F. and/or pressures of between 1,000 psig and 4,500 psig). A liquid-phase stream 1624 of heat transfer fluid from the steam separator 1602 may be provided back to the wellbore 302 and/or to condenser 1642. The condenser 1642 is any appropriate type of condenser capable of condensing a vapor-phase fluid. The condenser 1642 may be coupled to a cooling or refrigeration unit, such as a cooling tower (not shown for conciseness).

The first turbine set 1604 includes one or more turbines 1606*a,b*. In the example of FIG. 16, the first turbine set includes two turbines 1606*a,b*. However, the first turbine set 1604 can include any appropriate number of turbines for a given need. The turbines 1606*a,b* may be any known or yet to be developed turbine for electricity generation. The turbine set 1604 is connected to the steam separator 1602 and is configured to generate electricity from the gas-phase heat transfer fluid (e.g., steam) received from the steam separator 1602 (stream 1622). A stream 1630 exits the set of turbines 1604. The stream 1630 may be provided to the condenser 1642 and then back to the wellbore 302.

If the heat transfer fluid is at a sufficiently high temperature, as may be uniquely and more efficiently possible using the wellbore 302, a stream 1632 of gas-phase heat transfer fluid may exit the first turbine set 1604. Stream 1632 may be provided to a second turbine set 1608 to generate additional electricity. The turbines 1610*a,b* of the second turbine set 1608 may be the same as or similar to turbines 1606*a,b*, described above.

All or a portion of stream 1632 may be sent as gas-phase stream 1634 to a thermal process 1614. Process 1614 is generally a process requiring gas-phase heat transfer fluid at or near the conditions of the heat transfer fluid exiting the first turbine set 1604. For example, the thermal process 1614 may include one or more thermochemical processes requiring steam or another heat transfer fluid at or near the temperature and pressure of stream 1632 (e.g., temperatures of between 250° F. and 1,500° F. and/or pressures of between 500 psig and 2,000 psig). The second turbine set 1608 may be referred to as "low pressure turbines" because they operate at a lower pressure than the first turbine set 1604. Fluid from the second turbine set 1608 is provided to the condenser 1642 via stream 1636 to be condensed and then sent back to the wellbore 302.

An effluent stream 1638 from the second turbine set 1608 may be provided to one or more thermal process 1616*a,b*. Thermal processes 1616*a,b* generally require less thermal energy than processes 1612 and 1614, described above (e.g., processes 1616*a,b* may be performed temperatures of between 220° F. and 700° F. and/or pressures of between 15 psig and 120 psig). As an example, processes 1616*a,b* may include water distillation processes, heat-driven chilling processes, space heating processes, agriculture processes, aquaculture processes, and/or the like. For instance, an example heat-driven chiller process 1616*a* may be implemented using one or more heat driven chillers. Heat driven chillers can be implemented, for example, in data centers, crypto-currency mining facilities, or other locations in which undesirable amounts of heat are generated. Heat driven chillers, also conventionally referred to as absorption cooling systems, use heat to create chilled water. Heat driven chillers can be designed as direct-fired, indirect-fired, and heat-recovery units. When the effluent includes low pressure steam, indirect-fired units may be preferred. An effluent stream 1640 from all processes 1612, 1614, 1616*a,b*, may be provided back to the wellbore 302.

Additional Embodiments

The following descriptive embodiments are offered in further support of the one or more aspects of the present disclosure.

Embodiment 1. A method, comprising:

a borehole extending from a surface into an underground magma reservoir; and a boiler casing positioned within the borehole and extending into the magma reservoir, wherein the boiler casing comprises a float shoe at a terminal end to be positioned within the magma reservoir, the float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir, wherein the method optionally includes any one or more of the following limitations:

wherein the float shoe further comprises a top receptacle sized and shaped to receive a float shoe lock ring;

wherein the float shoe lock ring comprises a bottom portion that fits into the top receptacle, wherein a surface of the bottom portion comprises an indentation configured to fit a top end of the ball cage;

wherein the float shoe lock ring comprises a top portion comprising one or more indentations sized and shaped to secure a portion of an anchor receptacle;

wherein the movable ball is configured to move to a partially raised position when the drilling fluid is present, wherein flow is allowed through the opening when the movable ball is in the partially raised position;

wherein the movable ball is configured to move to a fully raised position in the presence of the magma from the magma reservoir, wherein flow is restricted through the opening when the movable ball is in the fully raised position; and wherein the float shoe comprises a tapered bottom end.

Embodiment 2. A boiler casing positioned within a borehole and extending into an underground magma reservoir, wherein the boiler casing comprises a float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir, wherein the boiler casing optionally includes any one or more of the following limitations:

wherein the float shoe further comprises a top receptacle sized and shaped to receive a float shoe lock ring;

wherein the float shoe lock ring comprises a bottom portion that fits into the top receptacle, wherein a surface of the bottom portion comprises an indentation configured to fit a top end of the ball cage;

wherein the float shoe lock ring comprises a top portion comprising one or more indentations sized and shaped to secure a portion of an anchor receptacle;

wherein the movable ball is configured to move to a partially raised position when the drilling fluid is present, wherein flow is allowed through the opening when the movable ball is in the partially raised position;

wherein the movable ball is configured to move to a fully raised position in the presence of the magma from the magma reservoir, wherein flow is restricted through the opening when the movable ball is in the fully raised position; and wherein the float shoe comprises a tapered bottom end.

Embodiment 3. A float shoe of a boiler casing to be positioned in a borehole extending into an underground magma reservoir, the float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir, wherein the float shoe optionally includes any one or more of the following limitations:

further comprising a top receptacle sized and shaped to receive a float shoe lock ring;

wherein the float shoe lock ring comprises a bottom portion that fits into the top receptacle, wherein a surface of the bottom portion comprises an indentation configured to fit a top end of the ball cage;

wherein the float shoe lock ring comprises a top portion comprising one or more indentations sized and shaped to secure a portion of an anchor receptacle;

wherein the movable ball is configured to move to a partially raised position when the drilling fluid is present, wherein flow is allowed through the opening when the movable ball is in the partially raised position; and wherein the movable ball is configured to move to a fully raised position in the presence of the magma from the magma reservoir, wherein flow is restricted through the opening when the movable ball is in the fully raised position.

Embodiment 4. A geothermal system, comprising:

a borehole extending from a surface into an underground magma reservoir; and a boiler casing positioned within the borehole and extending into the magma reservoir, wherein the boiler casing comprises a tubing anchor receptacle, the tubing anchor receptacle comprising:

an outer body comprising an opening passing therethrough;

a top receptacle formed in the outer body; and a grooved receptacle coupled to the top receptacle, wherein the grooved receptacle comprises:

a helical groove sized and shaped to receive a notch of a tubing anchor configured to be coupled to the tubing anchor receptacle; and a vertical groove coupled to the helical groove and configured to receive the notch of the tubing anchor after the notch traverses the helical groove and secure the notch in place, wherein the system optionally includes any one or more of the following limitations:

wherein the helical groove is configured to receive the notch of the tubing anchor; and direct the notch into a bottom of the vertical groove as the tubing anchor moves downwards;

wherein the vertical groove is configured to secure the tubing anchor in place in an upper position after the tubing anchor is raised;

wherein the outer body comprises an end section sized and shaped to fit securely in a float shoe coupled to the tubing anchor receptacle;

wherein the tubing anchor receptacle further comprises a conduit coupled to the grooved receptacle, the conduit sized and shaped to fit within an opening in the float shoe; and at least one sealing ring positioned around the conduit;

wherein the at least one sealing ring is a metal or alloy gasket; wherein the grooved receptacle further comprises a plurality of helical grooves, each sized and shaped to receive a notch of a plurality of notches of the tubing anchor; and wherein the grooved receptacle further comprises a plurality of vertical grooves, each vertical groove of the plurality of vertical grooves coupled to a corresponding helical groove of the plurality of vertical grooves.

Embodiment 5. A boiler casing positioned within a borehole and extending into an underground magma reservoir, wherein the boiler casing comprises a tubing anchor receptacle, the tubing anchor receptacle comprising:

an outer body comprising an opening passing therethrough;

a top receptacle formed in the outer body; and a grooved receptacle coupled to the top receptacle, wherein the grooved receptacle comprises:

a helical groove sized and shaped to receive a notch of a tubing anchor configured to be coupled to the tubing anchor receptacle; and a vertical groove coupled to the helical groove and configured to receive the notch of the tubing anchor after the notch traverses the helical groove and secure the notch in place, wherein the boiler casing optionally includes any one or more of the following limitations:

wherein the helical groove is configured to receive the notch of the tubing anchor; and direct the notch into a bottom of the vertical groove as the tubing anchor moves downwards;

wherein the vertical groove is configured to secure the tubing anchor in place in an upper position after the tubing anchor is raised;

wherein the outer body comprises an end section sized and shaped to fit securely in a float shoe coupled to the tubing anchor receptacle;

wherein the tubing anchor receptacle further comprises a conduit coupled to the grooved receptacle, the conduit sized and shaped to fit within an opening in the float shoe; and at least one sealing ring positioned around the conduit;

wherein the at least one sealing ring is a metal or alloy gasket;

wherein the grooved receptacle further comprises a plurality of helical grooves, each sized and shaped to receive a notch of a plurality of notches of the tubing anchor; and wherein the grooved receptacle further comprises a plurality of vertical grooves, each vertical groove of the plurality of vertical grooves coupled to a corresponding helical groove of the plurality of vertical grooves.

Embodiment 6. A tubing anchor receptacle of a boiler casing to be positioned in a borehole extending into an underground magma reservoir, the tubing anchor receptacle comprising:

an outer body comprising an opening passing therethrough;

a top receptacle formed in the outer body; and a grooved receptacle coupled to the top receptacle, wherein the grooved receptacle comprises:

a helical groove sized and shaped to receive a notch of a tubing anchor configured to be coupled to the tubing anchor receptacle; and a vertical groove coupled to the helical groove and configured to receive the notch of the tubing anchor after the notch traverses the helical groove and secure the notch in place, wherein the tubing anchor receptacle optionally includes any one or more of the following limitations:

wherein the helical groove is configured to receive the notch of the tubing anchor; direct the notch into a bottom of the vertical groove as the tubing anchor moves downwards; and the vertical groove is configured to secure the tubing anchor in place in an upper position after the tubing anchor is raised;

further comprising a conduit coupled to the grooved receptacle, the conduit sized and shaped to fit within an opening in a float shoe coupled to the tubing anchor receptacle; and at least one sealing ring positioned around the conduit, wherein the at least one sealing ring is a metal or alloy gasket; and wherein the grooved receptacle further comprises a plurality of helical grooves, each sized and shaped to receive a notch of a plurality of notches of the tubing anchor; and a plurality of vertical grooves, each vertical groove of the plurality of vertical grooves coupled to a corresponding helical groove of the plurality of vertical grooves.

Embodiment 7. A geothermal system, comprising:

a borehole extending from a surface into an underground magma reservoir;

a boiler casing positioned within the borehole and extending into the magma reservoir; and tubing positioned within the boiler casing, the tubing comprising a tubing anchor with at least one notch, wherein the boiler casing comprises a tubing anchor receptacle configured to receive the tubing anchor and secure the tubing anchor in place, the tubing anchor receptacle comprising a grooved receptacle that comprises:

a helical groove sized and shaped to receive the at least one notch of the tubing anchor; and a vertical groove coupled to the helical groove and configured to receive the notch of the tubing anchor after the notch traverses the helical groove and secure the notch in place, such that the tubing cannot lift out of the boiler casing, wherein the geothermal system optionally includes any one or more of the following limitations:

wherein the helical groove is configured to receive the notch of the tubing anchor; and direct the notch into a bottom of the vertical groove as the tubing anchor moves downwards;

wherein the vertical groove is configured to secure the tubing anchor in place in an upper position after the tubing anchor is raised and rotated;

wherein the tubing anchor receptacle further comprises a conduit below the grooved receptacle; and at least one sealing ring positioned around the conduit;

wherein the at least one sealing ring is a metal or alloy gasket;

wherein the tubing anchor is sized and shaped to fit within the conduit; and the at least one sealing ring provides a fluid seal to prevent or limit fluid flow out of the conduit when the tubing anchor is secured;

wherein the tubing anchor receptacle is coupled to a float shoe comprising a metal ball check valve that closes in the presence of magma from the magma reservoir; and wherein the tubing anchor is hollow with an opening at a bottom end, wherein the hollow tubing anchor provides a volume for holding fluid, magma, or debris that inadvertently passes the metal ball check valve.

Embodiment 8. A tubing positioned within a boiler casing positioned within a borehole extending into an underground magma reservoir, the tubing comprising:

a tubing anchor with at least one notch, wherein the boiler casing comprises a tubing anchor receptacle configured to receive the tubing anchor and secure the tubing anchor in place, the tubing anchor receptacle comprising a grooved receptacle that comprises:

a helical groove sized and shaped to receive the at least one notch of the tubing anchor; and a vertical groove coupled to the helical groove and configured to receive the notch of the tubing anchor after the notch traverses the helical groove and secure the notch in place, such that the tubing cannot lift out of the boiler casing, wherein the tubing optionally includes any one or more of the following limitations:

wherein the helical groove is configured to receive the notch of the tubing anchor; and direct the notch into a bottom of the vertical groove as the tubing anchor moves downwards;

wherein the vertical groove is configured to secure the tubing anchor in place in an upper position after the tubing anchor is raised and rotated;

wherein the tubing anchor receptacle further comprises a conduit below the grooved receptacle; and at least one sealing ring positioned around the conduit;

wherein the at least one sealing ring is a metal or alloy gasket;

wherein the tubing anchor is sized and shaped to fit within the conduit; and the at least one sealing ring provides a fluid seal to prevent or limit fluid flow out of the conduit when the tubing anchor is secured;

wherein the tubing anchor receptacle is coupled to a float shoe comprising a metal ball check valve that closes in the presence of magma from the magma reservoir; and wherein the tubing anchor is hollow with an opening at a bottom end, wherein the hollow tubing anchor provides a volume for holding fluid, magma, or debris that inadvertently passes the metal ball check valve.

Embodiment 9. A method, comprising:

positioning a boiler casing within a borehole extending from a surface into an underground magma reservoir;

lowering tubing positioned within the boiler casing; and causing a tubing anchor of the tubing to engage a tubing receptacle of the boiler casing by:

inserting a notch of the tubing anchor into a helical groove of the tubing anchor receptacle;

moving the notch along the helical groove via a downward motion of the tubing; and securing the notch to a vertical groove of the tubing anchor receptacle by moving the tubing in an upwards direction, such that the tubing cannot lift out of the boiler casing, wherein the method optionally includes any one or more of the following limitations:

further comprising, prior to moving the tubing in the upwards direction, detecting a rotation of the tubing when the notch of the tubing anchor moves along the helical groove;

further comprising, prior to moving the tubing in the upwards direction, detecting a decrease in a weight of the tubing; and further comprising positioning the boiler casing within the borehole by lowering the boiler casing into the borehole until a portion of the boiler casing extends into the magma reservoir; and after completion of lowering the boiler casing into the borehole, allowing a metal ball valve to close in a float shoe of the boiler casing.

Although embodiments of the disclosure have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. Moreover, items shown or discussed as coupled or directly coupled or communicating with each other may be indirectly coupled or communicating through some interface device, or intermediate component whether electrically, mechanically, fluidically, or otherwise.

While this disclosure has been particularly shown and described with reference to preferred or example embodiments, it will be understood by those skilled in the art that various changes in form and detail may be made therein without departing from the spirit and scope of the disclosure. Accordingly, this disclosure includes all modifications and equivalents of the subject matter recited in the claims appended hereto as permitted by applicable law. Changes, substitutions and alterations are ascertainable by one skilled in the art and could be made without departing from the spirit and scope disclosed herein. Moreover, any combination of the above-described elements in all possible variations thereof is encompassed by the disclosure unless otherwise indicated herein or otherwise clearly contradicted by context.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

What is claimed is:

1. A float shoe of a boiler casing to be positioned in a borehole extending into an underground magma reservoir, the float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir.

2. The float shoe of claim 1, further comprising a top receptacle sized and shaped to receive a float shoe lock ring.

3. The float shoe of claim 2, wherein the float shoe lock ring comprises a bottom portion that fits into the top receptacle, wherein a surface of the bottom portion comprises an indentation configured to fit a top end of the ball cage.

4. The float shoe of claim 2, wherein the float shoe lock ring comprises a top portion comprising one or more indentations sized and shaped to secure a portion of an anchor receptacle.

5. The float shoe of claim 1, wherein the movable ball is configured to move to a partially raised position when the drilling fluid is present, wherein flow is allowed through the opening when the movable ball is in the partially raised position.

6. The float shoe of claim 1, wherein the movable ball is configured to move to a fully raised position in the presence of the magma from the magma reservoir, wherein flow is restricted through the opening when the movable ball is in the fully raised position.

7. A boiler casing positioned within a borehole and extending into an underground magma reservoir, wherein the boiler casing comprises a float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir.

8. The boiler casing of claim 7, wherein the float shoe further comprises a top receptacle sized and shaped to receive a float shoe lock ring.

9. The boiler casing of claim 8, wherein the float shoe lock ring comprises a bottom portion that fits into the top receptacle, wherein a surface of the bottom portion comprises an indentation configured to fit a top end of the ball cage.

10. The boiler casing of claim 8, wherein the float shoe lock ring comprises a top portion comprising one or more indentations sized and shaped to secure a portion of an anchor receptacle.

11. The boiler casing of claim 7, wherein the movable ball is configured to move to a partially raised position when the drilling fluid is present, wherein flow is allowed through the opening when the movable ball is in the partially raised position.

12. The boiler casing of claim 7, wherein the movable ball is configured to move to a fully raised position in the presence of the magma from the magma reservoir, wherein flow is restricted through the opening when the movable ball is in the fully raised position.

13. The boiler casing of claim 7, wherein the float shoe comprises a tapered bottom end.

14. A geothermal system, comprising:

a borehole extending from a surface into an underground magma reservoir; and a boiler casing positioned within the borehole and extending into the magma reservoir, wherein the boiler casing comprises a float shoe at a terminal end to be positioned within the magma reservoir, the float shoe comprising:

a body with an opening passing therethrough;

a ball cage secured within the opening and configured to contain a movable ball; and the movable ball, wherein the movable ball has an effective density that is greater than a first density of drilling fluid used to prepare the borehole and less than a second density of magma in the magma reservoir.

15. The geothermal system of claim 14, wherein the float shoe further comprises a top receptacle sized and shaped to receive a float shoe lock ring.

16. The geothermal system of claim 15, wherein the float shoe lock ring comprises a bottom portion that fits into the top receptacle, wherein a surface of the bottom portion comprises an indentation configured to fit a top end of the ball cage.

17. The geothermal system of claim 15, wherein the float shoe lock ring comprises a top portion comprising one or more indentations sized and shaped to secure a portion of an anchor receptacle.

18. The geothermal system of claim 14, wherein the movable ball is configured to move to a partially raised position when the drilling fluid is present, wherein flow is allowed through the opening when the movable ball is in the partially raised position.

19. The geothermal system of claim 14, wherein the movable ball is configured to move to a fully raised position in the presence of the magma from the magma reservoir, wherein flow is restricted through the opening when the movable ball is in the fully raised position.

20. The geothermal system of claim 14, wherein the float shoe comprises a tapered bottom end.

* * * * *